US011111648B2

(12) United States Patent
McQuaid

(10) Patent No.: US 11,111,648 B2
(45) Date of Patent: Sep. 7, 2021

(54) BOOM SYSTEM FOR BREAKING AND MANOUEVRING OVERSIZE MATERIAL

(71) Applicant: MCQUAID ENGINEERING LTD, Dungannon (GB)

(72) Inventor: Paul McQuaid, Dungannon (GB)

(73) Assignee: McQuaid Engineering Ltd, Dungannon (GB)

( * ) Notice: Subject to any disclaimer, the term of this patent is extended or adjusted under 35 U.S.C. 154(b) by 296 days.

(21) Appl. No.: 16/079,833

(22) PCT Filed: Feb. 24, 2017

(86) PCT No.: PCT/EP2017/054425
§ 371 (c)(1),
(2) Date: Aug. 24, 2018

(87) PCT Pub. No.: WO2017/144711
PCT Pub. Date: Aug. 31, 2017

(65) Prior Publication Data

US 2019/0100898 A1 Apr. 4, 2019

(30) Foreign Application Priority Data

Feb. 24, 2016 (GB) ..... 1603231

(51) Int. Cl.
*E02F 3/30* (2006.01)
*E02F 3/96* (2006.01)
(Continued)

(52) U.S. Cl.
CPC ..... *E02F 3/966* (2013.01); *E02F 3/286* (2013.01); *E02F 3/30* (2013.01); *E02F 3/301* (2013.01);
(Continued)

(58) Field of Classification Search
CPC ... E02F 3/286; E02F 3/325; E02F 3/38; E02F 3/369; E02F 3/30; E02F 3/96; E02F 3/32;
(Continued)

(56) References Cited

U.S. PATENT DOCUMENTS 2,877,915 A 3/1959 Puim
3,121,499 A * 2/1964 La Barre, Jr. ..... B64F 5/50 414/542

(Continued)

FOREIGN PATENT DOCUMENTS

EP 2426265 3/2012
FR 2465034 3/1981

(Continued)

OTHER PUBLICATIONS

English Abstract of EP2426265.

(Continued)

*Primary Examiner* — Scott A Smith
(74) *Attorney, Agent, or Firm* — Preston Smirman; Smirman IP Law, PLLC

(57) ABSTRACT

The present invention provides a boom system 1 for breaking and manoeuvring oversize material. The boom system 1 is mounted or attached to a vehicle. The boom system 1 comprises a base 2, a column 5 protruding upwardly from the base 2 and a boom arm 3 moveably connectable to the upright column 5 at connection point 16. A moving arrangement 4 is provided to move all or part of the upright column 5 towards and away from the base 2 so that the connection 16 between the boom arm 3 and the upright column is moveable towards and away from the base 2. A mobile crusher comprising a boom system 1 for breaking and manoeuvring oversize material is also provided.

8 Claims, 25 Drawing Sheets

(51) Int. Cl.

| | |
|---|---|
| ***E02F 3/32*** | (2006.01) |
| ***E02F 3/38*** | (2006.01) |
| ***E21B 7/02*** | (2006.01) |
| ***E02F 3/28*** | (2006.01) |
| *E02F 3/36* | (2006.01) |
| *E21B 19/08* | (2006.01) |
| *E02F 9/16* | (2006.01) |
| *E02F 9/14* | (2006.01) |

(52) U.S. Cl.
CPC ..... *E02F 3/303* (2013.01); *E02F 3/305* (2013.01); *E02F 3/306* (2013.01); *E02F 3/32* (2013.01); *E02F 3/384* (2013.01); *E21B 7/02* (2013.01); *E02F 3/369* (2013.01); *E02F 3/38* (2013.01); *E02F 3/96* (2013.01); *E02F 9/14* (2013.01); *E02F 9/16* (2013.01); *E21B 7/022* (2013.01); *E21B 19/08* (2013.01)

(58) Field of Classification Search
CPC ... E02F 3/301; E02F 3/433; E02F 9/16; E02F 9/20; E02F 9/2004; E21B 7/02; E21B 19/08; E21B 7/022
USPC ..... 173/184, 185, 28, 42, 44, 192, 193; 414/227, 542, 547, 690, 700, 718, 723, 414/744.5
See application file for complete search history.

(56) References Cited

U.S. PATENT DOCUMENTS

| | | | | | |
|---|---|---|---|---|---|
| 3,836,025 | A * | 9/1974 | Olson | B66F 9/0655 | 414/547 |
| 4,095,306 | A * | 6/1978 | Norton | B08B 1/00 | 15/104.07 |
| 4,147,263 | A * | 4/1979 | Frederick | B66F 9/0655 | 414/718 |
| 4,274,796 | A * | 6/1981 | Phillips | E02F 3/286 | 414/690 |
| 4,575,305 | A | 3/1986 | Krajicek et al. | | |
| 4,858,700 | A * | 8/1989 | Shafer | E21B 7/025 | 173/185 |
| 4,964,778 | A * | 10/1990 | Muto | B66F 9/0655 | 414/700 |
| 5,106,257 | A * | 4/1992 | Braud | B66F 9/0655 | 212/231 |
| 5,203,072 | A * | 4/1993 | Boisture | B23P 19/024 | 29/726 |
| 5,403,145 | A * | 4/1995 | Cradeur | B23P 19/024 | 180/24.01 |
| 6,076,615 | A * | 6/2000 | Dalland | E02F 3/28 | 173/42 |
| 6,557,276 | B2 * | 5/2003 | Contoli | B66F 9/0655 | 187/234 |
| 6,793,024 | B2 * | 9/2004 | Albertson | B66F 11/046 | 173/184 |
| 7,556,107 | B2 * | 7/2009 | Weixler | E02D 7/16 | 173/184 |
| 9,045,320 | B2 * | 6/2015 | Turrini | B60P 3/1091 | |
| 2007/0003395 | A1 * | 1/2007 | Segerljung | E02F 3/286 | 414/227 |
| 2009/0230749 | A1 * | 9/2009 | Kostak | E02F 3/325 | 297/411.36 |
| 2009/0304485 | A1 * | 12/2009 | Yoshikawa | E04G 23/082 | 414/723 |
| 2011/0036608 | A1 * | 2/2011 | Nystrom | E21D 20/003 | 173/185 |

FOREIGN PATENT DOCUMENTS

| | | |
|---|---|---|
| SE | 459741 | 7/1989 |
| WO | 1991014050 | 9/1991 |
| WO | 2015150956 | 10/2015 |

OTHER PUBLICATIONS

English Abstract of FR2465034.
English Abstract of SE459741.
International Search Report dated Jun. 9, 2017.
Late Rpublication of International Search Report dated Jun. 9, 2017.
Written Opinion of the International Searching Authority dated Jun. 9, 2017.
International Preliminary Report on Patentability dated Aug. 28, 2018.

* cited by examiner

BOOM SYSTEM FOR BREAKING AND MANOUEVRING OVERSIZE MATERIAL

CROSS-REFERENCE TO RELATED APPLICATION

The instant application is a national phase of PCT International Application No. PCT/EP2017/054425 filed Feb. 24, 2017, and claims priority to GB Patent Application Serial No. 1603231.0 filed Feb. 24, 2016, the entire specifications of both of which are expressly incorporated herein by reference.

The present invention relates to boom systems, and in particular to a rock breaker/manoeuvring boom system for use on mobile crushers, impactor crushers and cone crusher plants. Rock breaker boom systems are also known as pedestal booms, manipulators, and articulated arms.

Crushers are widely used for crushing materials, such as rocks and recyclable aggregate, conveyed via a grizzly into predetermined particle sizes. Crusher blockages, where oversize material stalls the crusher or blocks the grizzly can cause problems due to increased down-time and maintenance. In particular, when oversize material is blocking the grizzly, a crusher operation will have to be stopped and an operator will have to enter the grizzly to manually clear the blockage using a pneumatic drill. The operator may also manually manipulate the material by crowbar or similar device, or by an external excavator. These are slow and laborious operations, which can also be replete with potential for injury. It is desirable to provide a boom system to enable an operator to remotely control an impact hammer to break/manoeuvre the oversize material on the grizzly before they are fed to the crusher and/or within the crusher, jaw, impactor or cone itself. It is particularly desirable for such boom systems to be mobile boom systems for use with the mobile crusher. The mobile boom system should preferably be compact enough to remain on the mobile crusher during transit to eliminate down-time on site for assembly and disassembly of the boom system.

Solutions have been developed which mount a mobile boom system to an external side portion of the crusher close to the grizzly. The mobile boom system comprises a column extending from a base, an actuatable boom arm pivotally coupled to the column, an actuatable dipper arm pivotally coupled to the boom arm, and an actuatable tool head pivotally coupled to the dipper arm. To minimize any increase in the dimensions of the crusher and to keep the crusher roadworthy, the mobile boom system is mounted close to the external side portion of the crusher, and at a low position. For the same reason, the height of the column is minimized to avoid the mobile boom system increasing the height of the crusher. The boom system should be attached to a standard crusher without change or modification to the machine itself. Further, the standard crusher with boom system attached thereto should remain within international transport dimensions regarding height and width.

The above construction enables the mobile boom system to adopt a compact transport configuration minimizing any increase in the height or width of the crusher due to the addition of the mobile boom system. For example, in some known arrangements, the boom arm, dipper arm, and tool head can be arranged such that the tool head is compactly stored in a void space just above the caterpillar tracks or wheels on one side of the crusher.

Once arrived at the site, the boom arm, dipper arm, and tool head are actuated from the compact configuration to an in-use configuration. A slewing system provided in the base rotates the mobile boom system about the vertical axis such that the dipper arm and tool head enter the space above the grizzly. The boom arm, dipper arm, tool head and slewing system can then be used in combination to position the tool head such that a hammer of the tool head can engage with oversized material in the grizzly.

While the above mobile boom system has a compact transport configuration, the range of motion of the system is limited due to the limited range of motion through which the boom arm can be actuated. Due to the short nature of the column, the limited space available, and the need to provide sufficient mechanical advantage, the hydraulic ram used to actuate the boom arm relative to the column is located on the underside of the mobile boom system and spans across most of the length of the boom arm. As the mobile boom system is mounted close to the external side portion of the crusher, the boom arm is actuatable through a limited angle with respect to the column before the hydraulic ram contacts with the external side portion of the crusher, stopping further movement. This means that a significant portion of the boom arm will remain on the wrong side or the outside of the external side portion of the crusher and will not extend into the space above the grizzly. The range of motion of the mobile boom system during use is thus largely determined by the range of motion of the slewing system, range of motion of the dipper arm and range of motion of the tool head, with the boom arm playing a more limited role due to the proximal nature of the base and side wall of the crusher. Further, the location of the hydraulic ram on the underside of the mobile boom system means that it is exposed to debris from the grizzly which can damage the hydraulic ram, increasing down-time and maintenance and thus end user costs and frustration. Furthermore, operator error will often lead to the hydraulic ram impacting with the side wall of the crusher during use, leading to damage to the hydraulic ram.

It is an object of the present invention to obviate or mitigate the problems of limited range of motion and potential for damage due to debris in boom systems.

Accordingly, the present invention provides a boom system adaptable for breaking and/or manoeuvring oversize material, the boom system being adapted to be mounted on or attached to a vehicle, the boom system comprising: a base; a column protruding upwardly from the base; a boom arm moveably connectable to the upright column; and means for moving all or part of the upright column towards and away from the base so that the connection between the boom arm and the upright column is moveable towards and away from the base.

Advantageously, the boom system of the present invention has an upright column of which all or part is moveable so that the connection point between the boom arm and the upright column moves towards and away from the base. In this way, greater flexibility and control is provided as the movement of the upright column also influences the range of motion and mechanical advantage of the boom system.

Ideally, the boom system is mountable on a vehicle with a hopper.

Preferably, the boom system is mountable on the vehicle at a position enabling the boom system to engage with material within the hopper of the vehicle.

Ideally, the boom system is mountable so as to be proximal to the hopper of the vehicle.

Preferably, the boom system is mountable so as to be proximal to an upright wall of the hopper of the vehicle.

Ideally, the boom system is mountable so as to be proximal to an upright lateral wall of the hopper of the vehicle.

Most preferably, the boom system is mountable on a supporting frame or chassis of the vehicle or hopper.

Preferably, the vehicle is a crusher comprising a grizzly, the boom system being mountable to the crusher at a position enabling the boom system to engage with material on the grizzly and/or material disposed within a jaw of the crusher.

Ideally, the crusher is a mobile crusher. Advantageously, the boom system is mountable on either side of the crusher and is orientable left or right for parking. This allows the boom system to be universal and interchangeable.

Preferably, the means for moving all or part of the upright column being adaptable to move the connection between the boom arm and the upright column in a generally vertical direction.

Ideally, the means for moving all or part of the upright column being adaptable to move the connection between the boom arm and the upright column towards and away from the top of the upright wall of the hopper.

Advantageously, moving the connection between the boom arm and the upright column towards the upright wall of the hopper increases the range of motion of the boom arm. This is because the boom arm is able to actuate through a greater angle with respect to the upright column before it impacts with the upright wall of the hopper. As such, more of the boom arm will extend into the space above the grizzly, and the range of motion of the boom system is increased as well as the mechanical advantage.

Preferably, the means for moving all or part of the upright column being adaptable to move the connection between the boom arm and the upright column to a position such that the boom system is able to engage with oversize material in the hopper.

Ideally, the means for moving all or part of the upright column being adaptable to move the connection between the boom arm and the upright column to be proximal to, level with, or above the top of the upright wall of the hopper. Advantageously, the range of motion of the boom arm and the mechanical advantage of the boom arm can be further maximised by moving the connection point between the boom arm and the upright column to be proximal to, level with, or above the top of the upright wall of the hopper.

Preferably, the means for moving all or part of the upright column being adaptable to move the connection between the boom arm and the upright column such that the boom arm substantially or completely extends into the space above the hopper.

Advantageously, this means that the upright wall of the hopper does not limit movement of the boom arm and the range of motion and mechanical advantage of the boom system is increased.

Ideally, the means for moving all or part of the upright column being adaptable to move the connection between the boom arm and the upright column such that the boom arm is able to extend substantially horizontally into the space above the hopper.

Preferably, the boom system being adaptable to remain mounted to the vehicle during transit. In other words, the boom system is a mobile boom system.

Ideally, the means for moving all or part of the upright column being adaptable to move the boom system between a compact transport configuration where the boom system does not substantially increase the height or width of the vehicle, and an in-use configuration where the connection between the upright column and the boom arm is moveable towards and away from the top of the wall of the hopper.

Advantageously, when in the compact transport configuration, the vehicle which the boom system is mounted on has a minimal increase in profile, rendering it easier to transport. For most vehicles, such as standard crushers, mounting the mobile boom system of the present invention will not exceed current international regulations regarding the maximum height and width for transport vehicles.

Ideally, the connection between the boom arm and the upright column is in its lower-most position when in the compact transport configuration.

Preferably, the connection between the upright column and the boom arm is in its upper-most position when in the in-use configuration.

Ideally, in the in-use configuration, the means for moving all or part of the upright column being adaptable to move the connection between the boom arm and the upright column towards and away from the top of the upright wall of the hopper.

Preferably, in the in-use configuration, the means for moving all or part of the upright column being adaptable to move the connection between the boom arm and the upright column to a position such that the boom system is able to engage with oversize material.

Ideally, in the in-use configuration, the means for moving all or part of the upright column being adaptable to move the connection between the boom arm and the upright column to be proximal to, level with, or above the top of the upright wall of the hopper.

Preferably, in the in-use configuration, the means for moving all or part of the upright column being adaptable to move the connection between the boom arm and the upright column such that the boom arm substantially or completely extends into the space above the hopper.

Ideally, in the in-use configuration, the means for moving all or part of the upright column being adaptable to move the connection between the boom arm and the upright column such that the boom arm is able to extend substantially horizontally into the space above the hopper.

Advantageously, the means for moving all or part of the upright column enables the boom system to adopt a compact transport configuration where it does not significantly increase the height or width of the vehicle on which it is attached. During use, the means for moving all or part of the upright column can raise the height of the boom system such that all or a significant portion of the boom arm extends into the work space. This provides the boom arm with a greater range of motion and mechanical advantage than that of conventional mobile boom systems simply by moving the connection between the boom arm and the upright column towards and away from the base the upright column is mounted on. The range of motion of the boom arm can be further maximized by moving the connection point between the boom arm and the upright column to be proximal to, level with, or above the top of the wall of the hopper.

Preferably, the base is integrally formed with the structural support frame of the vehicle or hopper. By integrally formed we mean that the mounting arrangement is designed as an integral part of the structure of the vehicle or hopper.

Alternatively, the base is fixedly or releasably coupleable to the vehicle or hopper. Advantageously, this enables the boom system to be removed from the vehicle or hopper after use, such as for maintenance.

Preferably, the base is mountable on the vehicle or hopper using fastening means.

Ideally, the fastening means is a mechanical fastening means.

Ideally, the base is mountable on the vehicle or hopper without substantial modification to the vehicle.

Ideally, the boom system comprises one or more actuators locatable on the outer side of the boom system.

Preferably, the boom system comprises one or more actuators locatable on the outer side of the boom system in use.

Preferably, the boom arm is an actuatable boom arm.

Ideally, the boom system further comprising a boom arm actuator for actuating the boom arm relative to the upright column.

Preferably, the boom arm actuator being connectable to the upright column at or about one end and the boom arm at or about the other end.

Ideally, the boom arm actuator is locatable on the outer side of the boom system. Preferably, the boom arm actuator is locatable on the outer side of the boom system in use. By outer side of the boom system we mean that the upright column is disposed between the boom arm actuator and the working area and/or tool in the in-use configuration.

Advantageously, due to the more elevated position of the upright column when in the in-use configuration, sufficient mechanical advantage for actuating the boom arm relative to the upright column can be provided by positioning the boom arm actuator on the outer side of the boom system. This reduces the risk of accidental contact between the boom arm actuator and the wall of the hopper and it also prevents chips, dust, dirt, grime and falling rock hitting against the boom arm actuator during use. This reduces the risk of damage and down time.

Ideally, the boom arm is actuatable through an angle of up to 90 degrees with respect to the upright column.

Preferably, the boom arm is actuatable through an angle of up to 120 degrees with respect to the upright column.

Advantageously, the means for moving all or part of the upright column enables the upright column to be in a more elevated position, when in the in-use configuration, than the columns used in conventional mobile boom systems whilst still maintaining the compact transport configuration. In the in-use configuration, the connection between the upright column and the boom arm can be close to, level with, or extend above the wall of the hopper such that the boom arm extends into the space above the grizzly. This is because the coupling between the upright column and the boom arm is movable towards and away from the top of the wall of the hopper. In this situation, the boom arm can be actuatable through an angle of up to 90 degrees or more with respect to the upright column enhancing the range of motion of the boom system.

Preferably, the boom arm actuator is a telescopic actuator.

Ideally, the boom arm actuator is an extensible and retractable ram.

Preferably, the ram is a pressure-fluid operated ram.

Ideally, the ram is hydraulic.

Alternatively, the boom arm actuator is driven by a motor or screw worm.

Preferably, the boom system further comprising a dipper arm connectable to the boom arm.

Ideally, the boom system further comprising a tool head connectable to the dipper arm.

Preferably, the dipper arm is pivotally coupleable to the tool head.

Preferably, the dipper arm is pivotally coupleable to the boom arm, and the boom arm connectable to the tool head via the dipper arm.

Ideally, the dipper arm is an actuatable dipper arm.

Preferably, the boom system further comprising a dipper arm actuator for actuating the dipper arm relative to the boom arm.

Ideally, the dipper arm actuator is connectable to the boom arm at or about one end and the dipper arm at or about the other end.

Ideally, the dipper arm actuator is locatable on the outer side of the boom system. Preferably, the dipper arm actuator is locatable on the outer side of the boom system in use. By outer side of the boom system we mean that the boom arm is disposed between the dipper arm actuator and the working area and/or tool in the in-use configurations. Advantageously, having the dipper arm actuator on the outer side of the boom system reduces the risk of accidental contact between the dipper arm actuator and the wall of the hopper, a common source of damage to the actuators in conventional boom systems. Further, it also prevents or reduces the likelihood of chips, dust, dirt, grime and/or falling rock hitting against the dipper arm actuator during use. As a consequence, the risk of damage to the boom system and down-time are reduced.

Preferably, the dipper arm is actuatable through an angle of up to 90 degrees with respect to the boom arm.

Ideally, the dipper arm is actuatable through an angle of up to 120 degrees with respect to the boom arm.

Preferably, the dipper arm actuator is a telescopic actuator.

Ideally, the dipper arm actuator is an extensible and retractable ram.

Preferably, the ram is a pressure-fluid operated ram.

Ideally, the ram is hydraulic.

Alternatively, the dipper arm actuator is driven by a motor or screw worm.

Preferably, the tool head is an actuatable tool head.

Ideally, the boom system further comprises a tool head actuator for actuating the tool head relative to the dipper arm.

Preferably, the tool head actuator is connectable to the dipper arm at or about one end and the tool head at or about the other end.

Ideally, the tool head actuator is locatable on the outer side of the boom system. Preferably, the tool head actuator is locatable on the outer side of the boom system in use. By outer side of the boom system, we mean that the dipper arm is disposed between the tool head actuator and the work area and/or tool in the in-use configuration.

Advantageously, having the tool head actuator on the outer side of the boom system reduces the risk of accidental contact between the dipper arm actuator and the wall of the hopper, a common source of damage to the actuators in conventional boom systems. Further, it also prevents or reduces the likelihood of chips, dust, dirt, grime and/or falling rock hitting against the dipper arm actuator during use. As a consequence, the above arrangement reduces the risk of damage to the boom system and down-time.

Ideally, the tool head is actuatable through an angle of up to 90 degrees with respect to the dipper arm.

Preferably, the tool head is actuatable through an angle of up to 120 degrees with respect to the dipper arm.

Ideally, the tool head actuator is a telescopic actuator.

Preferably, the tool head actuator is an extensible and retractable ram.

Ideally, the ram is a pressure-fluid operated ram.

Preferably, the ram is hydraulic.

Alternatively, the tool head actuator is driven by a motor or screw worm.

Ideally, the tool head is adaptable for breaking and/or manoeuvring oversize material.

Preferably, the tool head comprises an actuatable hammer.

Ideally, the actuatable hammer is a hydraulic hammer.

Preferably, the tool head comprises a vibrating poker.

Preferably, the boom system further comprises a means for rotating the upright column.

Ideally, the means for rotating the upright column being adaptable to rotate the upright column about the vertical axis.

Ideally, the means for rotating the upright column is operably coupled between the base and the upright column.

Preferably, the means for rotating the upright column comprises an actuator.

Ideally, the means for rotating the upright column comprises a rotary actuator.

Ideally, the means for rotating the upright column comprises a slewing system.

Ideally, the slewing system being operably connected to the base or part of the base.

Preferably, the slewing system being adaptable to rotate the upright column about the vertical axis by up to 180 degrees, or preferably up to 360 degrees.

Ideally, the slewing system comprises a slew-ring and pinion.

Alternatively, the means for rotating the upright column comprises a gear on gear arrangement.

Alternatively still, the means for rotating the upright column comprises at least one telescopic actuator.

Preferably, the at least one telescopic actuator is an extensible and retractable ram.

Ideally, the ram is a pressure-fluid operated ram.

Preferably, the ram is hydraulic.

Alternatively, the telescopic actuator is driven by a motor or screw worm.

Preferably, the boom system further comprises a power supply for driving the boom system.

Ideally, the power supply is integral with the boom system.

Ideally, the power supply is a hydraulic power supply.

Preferably, the base further comprises bracing means for structurally supporting the boom system when in-use, the bracing means extending from the base and connectable to the vehicle.

In a first embodiment, the upright column being a length adjustable upright column, the means for moving all or part of the length adjustable upright column comprising drive means to increase/decrease the length of the length adjustable upright column. Advantageously, the drive means are adaptable to increase the length of the length adjustable upright column, and therefore move the boom arm upwards, generally vertically.

Ideally, the length adjustable upright column is moveable between a retracted configuration and an extended configuration.

Preferably, in the retracted configuration the length adjustable upright column has a height in a range of 80 cm to 120 cm.

Ideally, in the retracted configuration the length adjustable upright column has a height of 110 cm.

Preferably, in the extended configuration the length adjustable upright column has a height in a range of 110 cm to 180 cm.

Ideally, in the extended configuration the length adjustable upright column has a height of 150 cm.

Ideally, the length adjustable upright column being a telescopic upright column.

Preferably, the telescopic upright column comprises an external upright column fixedly mounted to the base, and an internal upright column moveably received in the external upright column and adaptable to move towards and away from the base, the connection between the boom arm and the upright column being locatable at or about the top of the internal upright column.

Ideally, the drive means being adaptable to move the internal upright column relative to the external upright column such that the connection between the boom arm and the upright column is moveable towards and away from the base.

Preferably, the drive means is locatable within the length adjustable or telescopic upright column.

Advantageously, having the drive means locatable within the upright column reduces the likelihood of chips, dust, dirt, grime and/or falling rock hitting against the drive means during use. As a consequence, the above arrangement reduces the risk of damage to the boom system and downtime.

Ideally, the drive means comprises at least one actuator having a first end portion connectable to the external upright column or base and a second end portion connectable to the internal upright column.

Preferably, the at least one actuator is a telescopic actuator.

Ideally, the at least one actuator is an extensible and retractable ram.

Preferably, the ram is a pressure-fluid operated ram.

Ideally, the ram is hydraulic.

Alternatively, the drive means is driven by a motor or screw worm.

Preferably, the at least one actuator is an extensible and retractable ram, the ram being extended when the boom system is in the in-use configuration and retracted when the boom system is in the transport configuration.

Ideally, the base further comprises bracing means for structurally supporting the boom system when in-use.

In a second embodiment, the means for moving all or part of the upright column comprises a moveable platform moveably mountable to the base and fixedly mountable to the upright column.

Ideally, the upright column is fixedly coupleable to the moveable platform and pivotally coupleable to the boom arm, the boom arm connectable to the moveable platform via the upright column.

Ideally, the moveable platform being moveable relative to the base so that the connection between the boom arm and the upright column is moveable towards and away from the base.

Preferably, the movable platform being moveably mounted on the base by a drive means.

Ideally, the drive means comprises at least one actuator.

Preferably, the at least one actuator is a telescopic actuator.

Ideally, the at least one actuator is an extensible and retractable ram.

Preferably, the ram is a pressure-fluid operated ram.

Ideally, the ram is hydraulic.

Alternatively, the drive means is driven by a motor or screw worm.

Preferably, the at least one actuator is connectable to the moveable platform at or about one end and the base at or about the other end.

Ideally, the moveable platform being slideably moveable on the base.

Ideally, a lower end of the at least one actuator is connectable to the moveable platform and an upper end of the at least one actuator is connectable to the base.

Preferably, the at least one actuator is an extensible and retractable ram, the ram being retracted when the boom system is in the in-use configuration and extended when the boom system is in the transport configuration.

Preferably, the upright column has a height in the range of 80 cm to 120 cm.

Ideally, the upright column has a height of 110 cm.

Ideally, the moveable platform is moveable through a range of 30 cm to 60 cm.

Preferably, the moveable platform is moveable through a range of 40 cm.

Ideally, the drive means comprises two actuators positioned at opposite lateral sides of the moveable platform, each actuator being connectable to the moveable platform at or about one end and the base at or about the other end.

Preferably, lower ends of the two actuators are connectable to the moveable platform and upper ends of the two actuators are connectable to the base.

Ideally, the two actuators are extensible and retractable rams, the rams being retracted when the boom system is in the in-use configuration and extended when the boom system is in the transport configuration.

Ideally, the base further comprises telescopic bracing means for structurally supporting the boom system when in-use, the telescopic bracing means extending from the moveable platform and connectable to the vehicle, the telescopic bracing means increasing/decreasing in length with the movement of the moveable platform.

Preferably, the base being a frame.

Ideally, the boom system further comprising fastening means for connecting the frame to the vehicle.

In a third embodiment, the upright column is a length adjustable upright column, the means for moving comprises drive means to increase/decrease the length of the length adjustable upright column, and further comprises a moveable platform moveably mountable to the base and fixedly mountable to the length adjustable upright column.

Ideally, the length adjustable upright column is fixedly coupleable to the moveable platform and pivotally coupleable to the boom arm, the boom arm connectable to the moveable platform via the length adjustable upright column.

Preferably, the moveable platform being moveable relative to the base so that the connection between the boom arm and the length adjustable upright column is moveable towards and away from the base.

Ideally, the length adjustable upright column is moveable between a retracted configuration and an extended configuration.

The skilled man will appreciate that the third embodiment can include any or all of the features of the first and second embodiments.

Ideally, the power supply of the boom system comprises a means for driving a working fluid, a working fluid delivery means and a means for diverting the working fluid from the fluid delivery means to one or more actuators powerable by the working fluid.

Preferably, the working fluid diverting means comprises a valve bank for diverting the working fluid to one or more actuators of the boom system.

Ideally, the working fluid diverting means comprises fluid delivery conduits for diverting the working fluid to the one or more actuators.

Ideally, the working fluid diverting means comprises fluid delivery conduits for diverting the working fluid from the valve bank to the one or more actuators.

Preferably, at least part of the means for diverting the working fluid to one or more of the actuators is mounted within the base.

Ideally, the base comprises a housing having a floor and a top wall formed for receiving a rotary actuator.

Preferably, the valve bank is mounted within the base.

Advantageously, having part of the diverting means locatable within the base reduces the likelihood of chips, dust, dirt, grime and/or falling rock hitting against this part of the diverting means during use. As a consequence, the above arrangement reduces the risk of damage to the diverting means and down-time. Furthermore, there is a reduced risk of corrosion to this part of the diverting means when it is housed within the base.

Preferably, the part of the diverting means which is mounted within the base is movably mounted within the base.

Ideally, the part of the diverting means which is mounted within the base is movably mounted within the base below the rotary actuator for moving the upright column relative to the base.

Preferably, the part of the diverting means which is mounted within the base is movably mounted on the floor of the base below the rotary actuator for moving the upright column relative to the base which is mounted on the top wall of the base.

Preferably, the part of the diverting means which is mounted within the base is rotatably mounted within the base.

Ideally, the part of the diverting means which is mounted within the base is movably mounted within the base so as to follow the movement of the upright column.

Preferably, the part of the diverting means which is mounted within the base is rotatably mounted within the base so as to follow the rotational movement of the upright column.

Ideally, the fluid delivery conduits are operably coupled between the part of the diverting means which is mounted within the base and the actuators.

Ideally, the rotary actuator has a central aperture.

Preferably, the fluid delivery conduits are operably coupled between the part of the diverting means which is mounted within the base and the actuators extending via the central aperture of the rotary actuator.

Preferably, the fluid delivery conduits are hydraulic hoses. Advantageously, the rigid yet flexible and resilient nature of the hydraulic hoses allow the hydraulic hoses to transmit the rotational forces acting on the hoses as a result of the upright column rotating through to the valve bank thereby causing the valve bank to rotate with the rotation of the upright column.

Ideally, the part of the diverting means which is mounted within the base is mounted on a rotating assembly.

Preferably, the axis of rotation of the rotating assembly of the part of the diverting means which is mounted within the base and the axis of rotation of the rotary actuator for rotating the upright column relative to the base are vertically aligned in use. Advantageously, this reduces the forces acting on the hydraulic hoses as the hydraulic hoses pass through the central aperture of the rotary actuator and extend down through the base to the rotating assembly thereby making the force transmission as efficient and aligned as possible by the positioning of the hydraulic hoses.

Ideally, the hydraulic hoses are spaced radially outwardly from the axis of rotation of the rotating assembly of the part of the diverting means which is mounted within the base. Advantageously, this allows the hydraulic hoses to apply a torque to the rotating assembly as the hydraulic hoses are rotated as a result of upright column rotation.

Ideally, the hydraulic hoses are angularly spaced around the axis of rotation of the rotating assembly of the part of the diverting means which is mounted within the base. Advantageously, this allows the hydraulic hoses to apply a torque to the rotating assembly as the hydraulic hoses are rotated as a result of upright column rotation.

Ideally, the working fluid delivery means are operably coupled between a fixed part of the base and the part of the diverting means which is movably mounted within the base.

Preferably, the ends of the working fluid delivery means are movably coupled to the fixed part of the base and movably coupled to the part of the diverting means which is movably mounted within the base.

Preferably, the working fluid delivery means comprise a number of hydraulic hoses movably coupled between a fixed part of the base and the part of the diverting means which is movably mounted within the base via swivel fittings on each end of the hydraulic hoses. Advantageously, this allows the part of the diverting means which is movably mounted within the base to rotate without the hydraulic hoses loosening.

Ideally, the working fluid delivery means comprise a feed, return and bleed hydraulic hose as well as a motor pump supply and return hydraulic hose.

Ideally, the fluid delivery conduits are operably coupled to the tool head actuator, the dipper arm actuator, the boom arm actuator and the upright column actuator.

Preferably, the fluid delivery conduits are hydraulic hoses operably coupled between the part of the diverting means which is movably mounted within the base and the tool head actuator, the dipper arm actuator, the boom arm actuator and the upright column actuator.

Ideally, the upright column comprises a mechanical lock for locking the upright column in the extended configuration.

Preferably, the mechanical lock is normally biased into a locking position via biasing mean when the upright column is in the extended configuration.

Ideally, the external upright column and the internal upright column each have an aperture extending through a wall of each column at a location so that the apertures align when the upright column is in the extended configuration for receiving the locking pin of the mechanical lock.

Ideally, the locking pin of the mechanical lock extends laterally through both the external upright column and the internal upright column physically locking them in the extended configuration when the lock pin is biased into the locking position.

Preferably, the mechanical lock is mounted on the outside of the external upright column with the locking pin in alignment and inserted into the locking aperture of the external upright column with the leading end of the locking pin abutting against the corresponding wall of the internal upright column under a biasing force of the biasing means until the locking aperture of the internal upright column aligns with the aperture of the external upright column.

Ideally, the biasing means acts on the trailing end of the locking pin.

Ideally, the locking pin has a visual indicator for indicating that the locking pin is in an upright column locking position or an upright column releasing position.

Preferably, the biasing means is a spring, most preferably a helical spring.

Ideally, the locking pin has an actuating member protruding laterally from the locking pin so as to be engageable with an actuator for retracting the locking pin out of the locking aperture of the internal upright column against the biasing force of the biasing means.

Ideally, the actuator comprises a wedge mounted on a ram, preferably hydraulic in such a way that the wedge is slidable between the outside surface of the external upright column and the actuating member of the locking pin for forcing the locking pin out of the aperture of the internal upright column overcoming the biasing force of the biasing means thereby releasing the upright column from the extended position.

Preferably, the actuating member of the locking pin is a hard steel bush. Advantageously, this reduces friction during activation of the lock and reduces wear on the wedge.

Preferably, the power supply has means for isolating the length adjustable upright column actuator and the mechanical lock actuator from the tool head actuator, the dipper arm actuator and the boom arm actuator.

Ideally, the isolating means of the boom system comprises a manual diverter valve.

Preferably, the manual diverter valve protrudes from the base.

Preferably, the power supply means of the boom system has switch means for operating the length adjustable upright column actuator and the mechanical lock actuator.

Ideally, the base comprises a box shaped housing with a floor and an open top wall with one wall be mounted against a wall of the crusher, the housing having removable guards for providing access to all hydraulic and electrical connections, the guards being attached to the housing via fastening means which are accessible to tools for removing and attaching the fastening means when the housing is mounted on the crusher.

Accordingly, the present invention further provides a mobile crusher comprising a boom system, the boom system being adaptable for breaking and/or manoeuvring oversize material, the boom system comprising: a base; a column protruding upwardly from the base; a boom arm moveably connectable to the upright column; and means for moving all or part of the upright column towards and away from the base so that the connection between the boom arm and the upright column is moveable towards and away from the base.

The skilled man will appreciate that the boom system of the mobile crusher referred to above can include any or all of the features of the boom system discussed previously.

The skilled man will also appreciate that all preferred or optional features of the invention described with reference to only some aspects or embodiments of the invention may be applied to all aspects of the invention.

It will be appreciated that optional features applicable to one aspect of the invention can be used in any combination, and in any number. Moreover, they can also be used with any of the other aspects of the invention in any combination and in any number. This includes, but is not limited to, the dependent claims from any claim being used as dependent claims for any other claim in the claims of this application.

The invention will now be described with reference to the accompanying drawings which shows by way of example only one embodiment of an apparatus in accordance with the invention.

Figure 1:
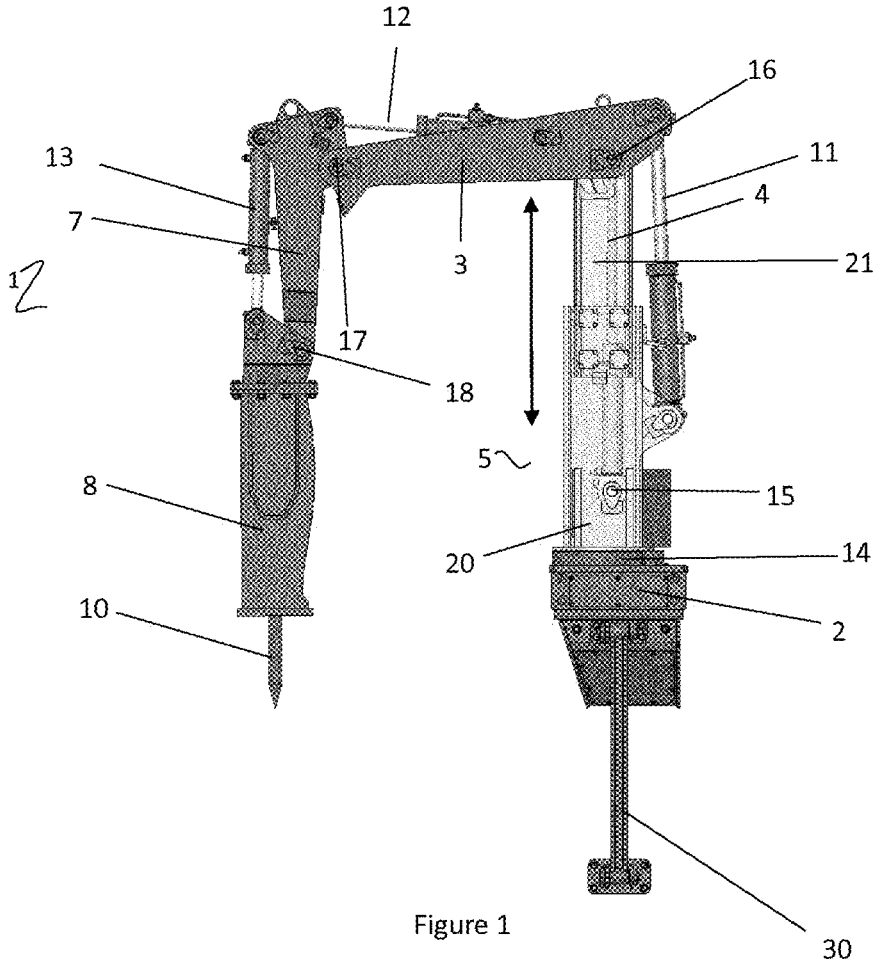
FIG. 1 is a partial cut-away view of a boom system according to a first embodiment of the present invention with a telescopic upright column in an elevated position.
Figure 2:
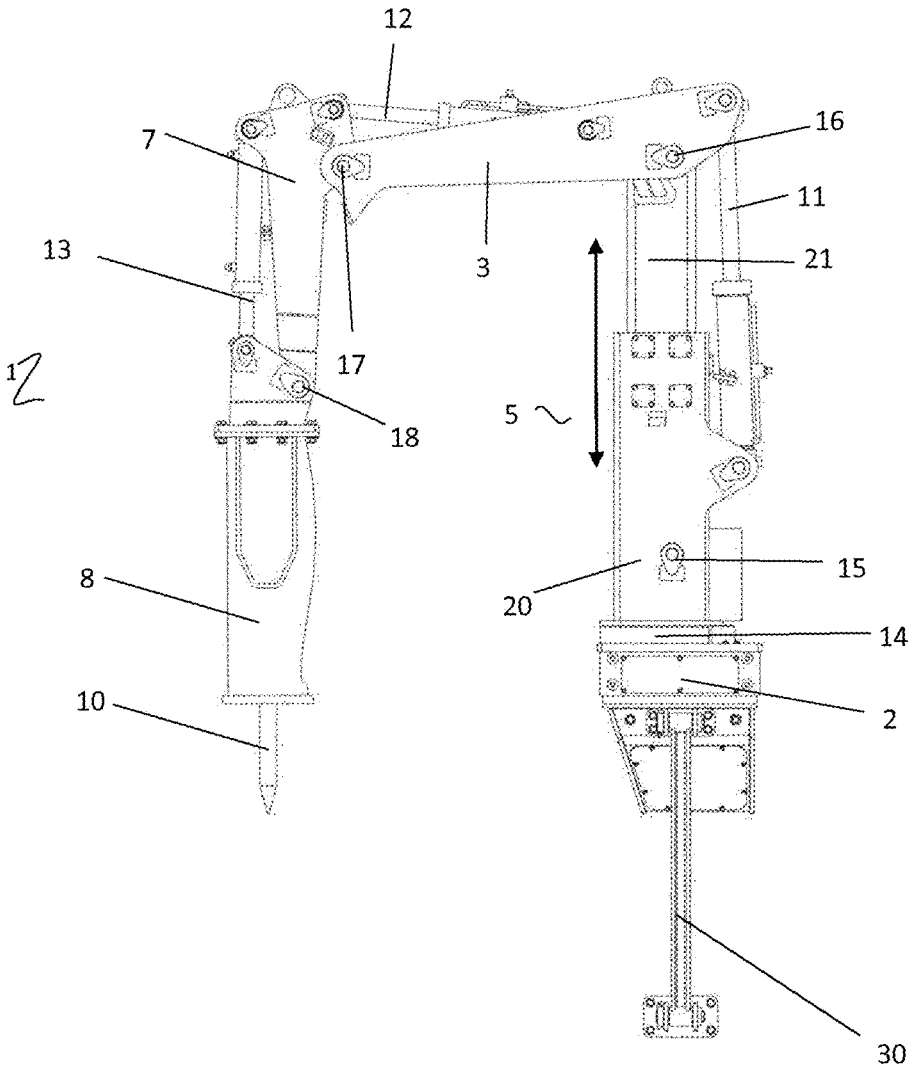
FIG. 2 is a lateral view of a boom system according to the first embodiment of the present invention with a telescopic upright column in an elevated position.
Figure 3:
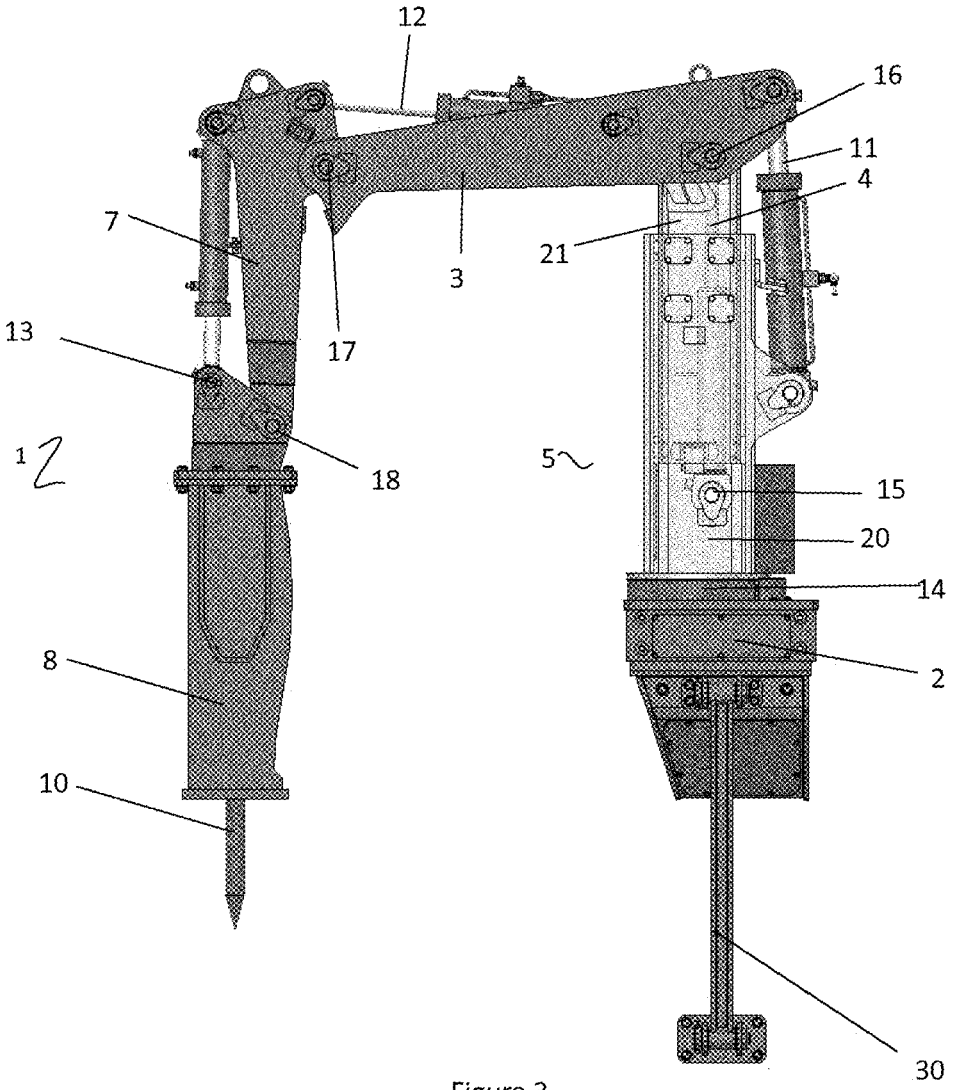
FIG. 3 is a partial cut-away view of a boom system according to the first embodiment of the present invention with a telescopic upright column in a lowered position.
Figure 4:
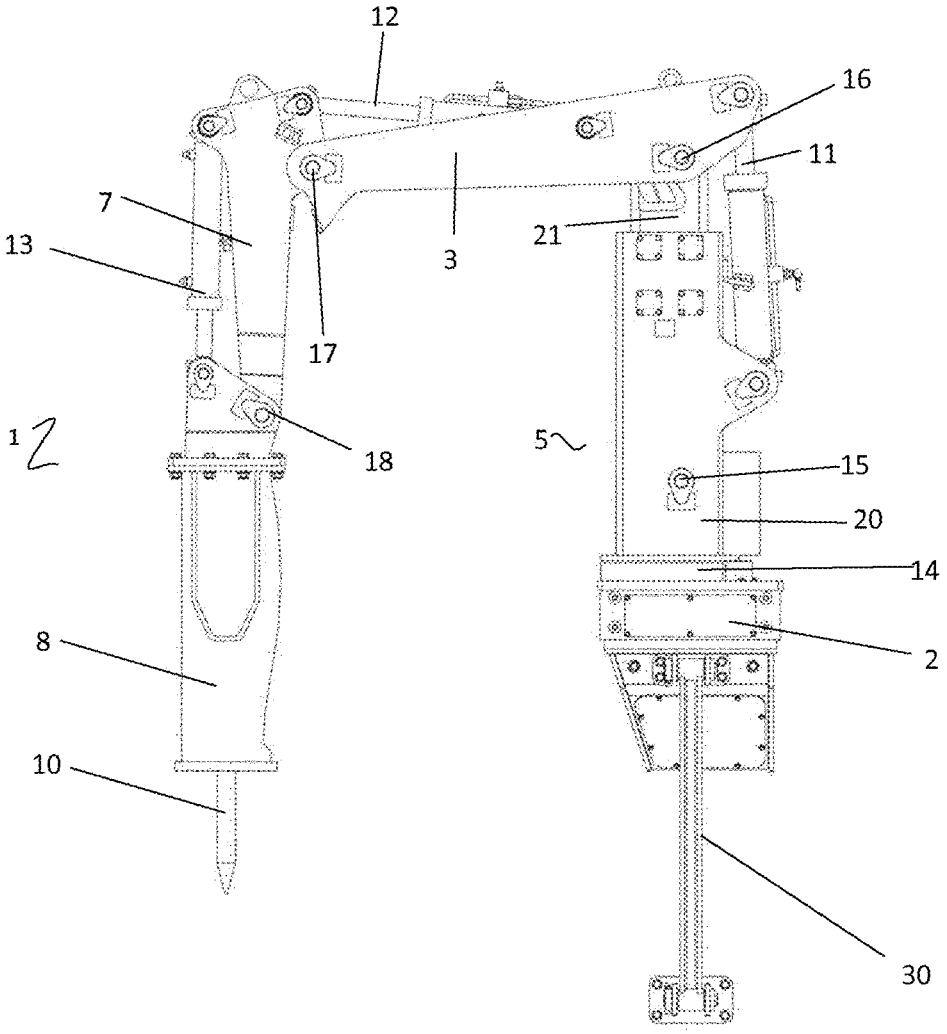
FIG. 4 is a lateral view of a boom system according to the first embodiment of the present invention with a telescopic upright column in a lowered position.

In FIGS. 1 to 10 there is shown a boom system generally indicated by the reference numeral 1 adaptable for breaking and/or manoeuvring oversize material such as rocks and recyclable aggregate. The boom system 1 is typically used for clearing or preventing blockages in the in a vehicle and is adapted to be mounted on the vehicle. The vehicle could be, for example, a crusher 40 having a grizzly 41 (see FIGS. 27 and 28). The boom system 1 has a base 2 (FIGS. 1 to 10) and a column generally indicated by the reference numeral 5 (FIGS. 1 to 10) protruding upwardly from the base 2. A boom arm 3 (FIGS. 1 to 10) is moveably connectable to the upright column 5 at connection point 16. A moving arrangement 4 (FIGS. 1, 3 and 8 to 10) is provided for moving all or part of the upright column 5 towards and way from the base 2, for example in the direction of the arrow shown in FIGS. 1 and 2. In this way, the movement arrangement 4 moves the connection 16 between the boom arm 3 and the upright column 5 towards and away from the base 2. As a result of this movement, greater flexibility and control is provided as the movement of the upright column 5 also influences the range of motion and mechanical advantage of the boom system 1.

Figure 27:
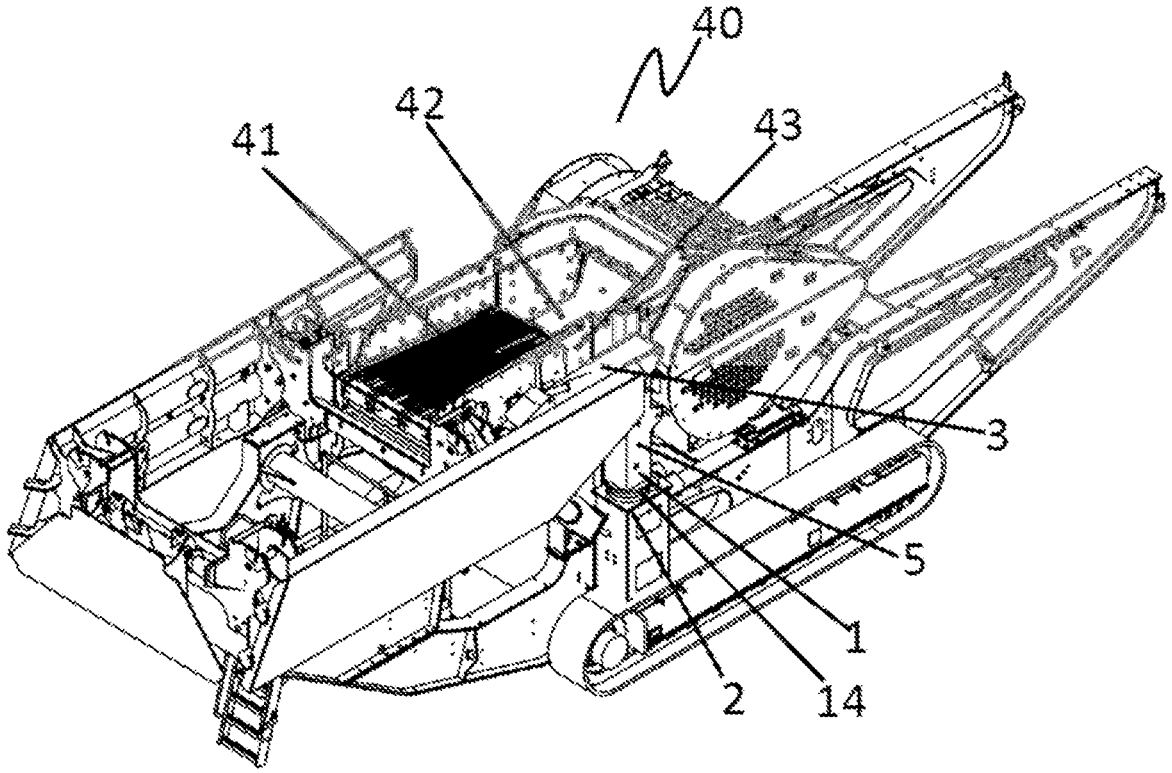
FIG. 27 is a perspective view of a boom system mounted on a crusher, the boom system being in a transport configuration.
Figure 28:
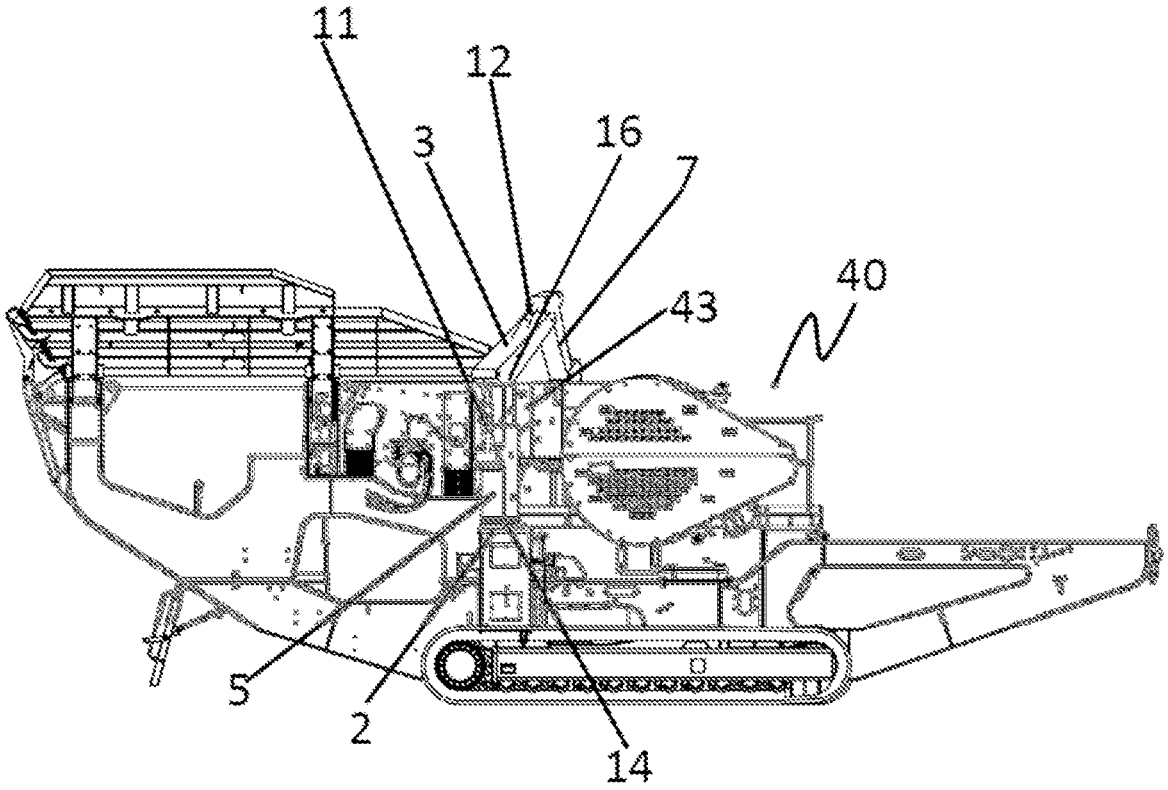
FIG. 28 is a second perspective view of a boom system mounted on a crusher, the boom system being in an extended, in use configuration.

The boom system 1 is mountable on a vehicle with a hopper 42, and is mountable at a position enabling the boom system 1 to engage with material within a hopper 42 of the vehicle 40. In some arrangements, the boom system 1 is mountable on the vehicle so as to be proximal to the hopper 42 of the vehicle 40 or even to be proximal to an upright wall 43 or upright lateral wall of the hopper 42 of the vehicle 40. In most embodiments, the boom system 1 is mountable on a supporting frame or chassis of the vehicle 40 or hopper 42 to provide additional structural support. The vehicle 40 will typically be a crusher 40, as illustrated in FIGS. 27 and 28 such as a mobile crusher, impactor crusher and cone crusher plant. In this arrangement, the boom system 1 is mountable to the crusher 40 at a position enabling the boom system 1 to engage with material on the grizzly 41 and/or material disposed with a jaw of the crusher 40. The boom system 1 is able to be mounted on either side of the crusher 40 and can be oriented left or right, such as for parking. This allows the boom system to be totally universal and interchangeable.

The moving arrangement 4 is adaptable to move the connection 16 between the boom arm 3 and the upright column 5 in a generally vertical direction. Further, the moving arrangement 4 is adaptable to move the connection 16 between the boom arm 3 and the upright column 5 towards and away from the top of the upright wall 43 of the hopper 42. Moving the connection 16 between the boom arm 3 and the upright column 5 towards the upright wall 43 of the hopper 42 increases the range of motion of the boom arm 3. This is because the boom arm 3 is able to actuate through a greater angle with respect to the upright column 5 before it impacts with the upright wall 43 of the hopper 42. As such, more of the boom arm 3 will extend into the space above the grizzly 41, and the range of motion of the boom system 1 is increased as well as the mechanical advantage. Furthermore, the moving arrangement 4 is adaptable to move the connection 16 between the boom arm 3 and the upright column 5 to a position such that the boom system 1 is able to engage with oversize material in the hopper 42. Further still, the moving arrangement 4 is adaptable to move the connection 16 between the boom arm 3 and the upright column 5 to be proximal to, level with, or above the top of the upright wall 43 of the hopper 42, further maximising the range of motion of the boom arm 3 and the mechanical advantage of the same. Further still, the moving arrangement 4 is adaptable to move the connection 16 between the boom arm 3 and the upright column 5 such that the boom arm 3 substantially or completely extends into the space above the hopper 42. Advantageously, this means that the upright wall 43 of the hopper 42 does not limit movement of the boom arm 3 and the range of motion and mechanical advantage of the boom system 1 is increased. Further still, the moving arrangement 4 is adaptable to move the connection 16 between the boom arm 3 and the upright column 5 such that the boom arm 3 is able to extend substantially horizontally into the space above the hopper 42.

In some arrangements, the boom system 1 is a mobile boom system 1 that is adaptable to remain mounted to the vehicle during transit. In this arrangement, the moving arrangement 4 is adaptable to move the boom system 1 between a compact transport configuration where the boom system 1 does not substantially increase the height or width of the vehicle, to an in-use configuration where the connection 16 between the upright column 5 and the boom arm 3 is moveable towards and away from the top of the wall 43 of the hopper 42. Advantageously, when in the compact transport configuration (see FIG. 27), the vehicle 40 with the boom system 1 mounted thereon has a minimal increase in profile, rendering it easier to transport. For most vehicles, such as standard crushers, mounting the mobile boom system 1 of the present invention will not exceed current international regulations regarding the maximum height and width for transport vehicles.

Figure 5:
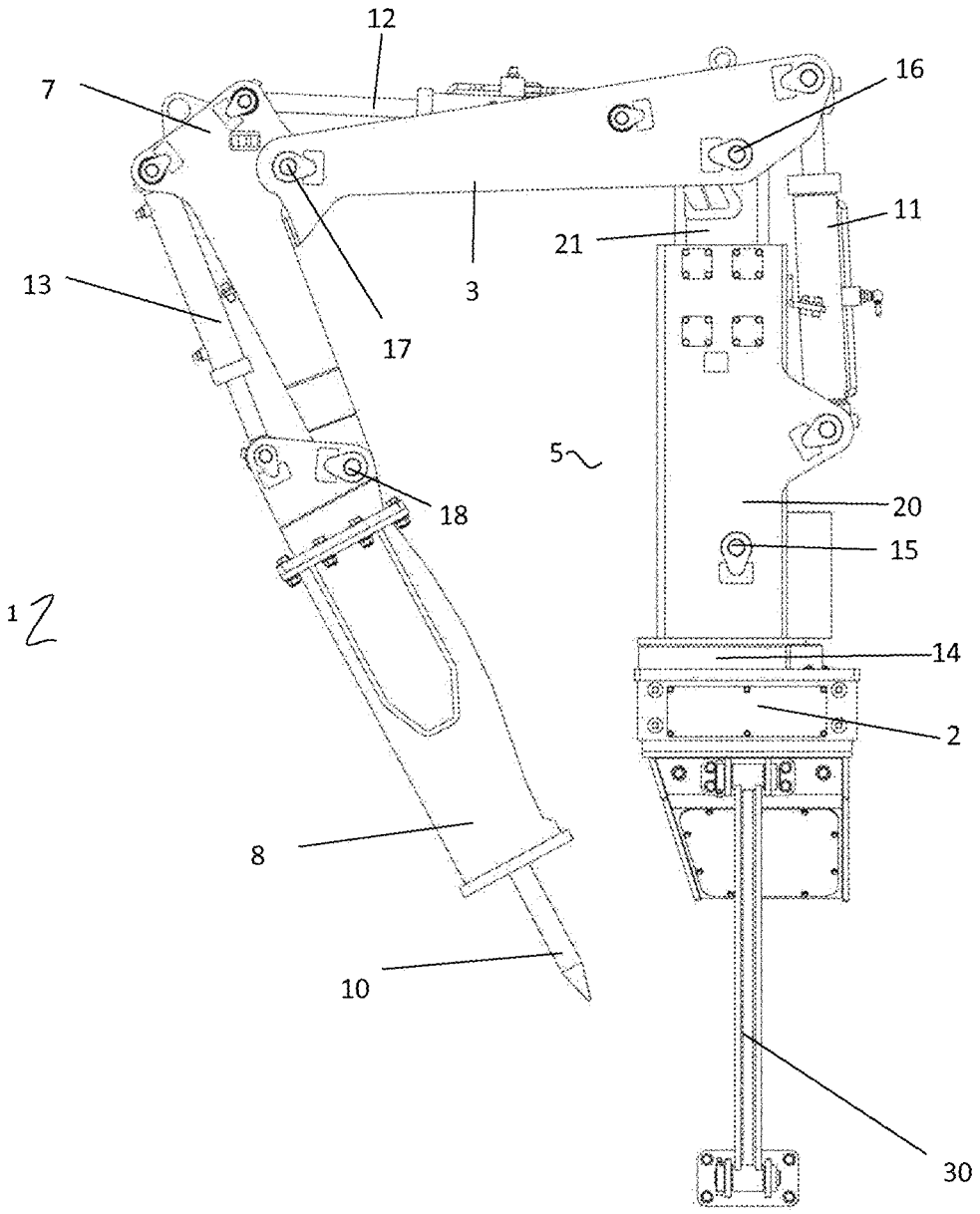
FIG. 5 is a lateral view of a boom system according to the first embodiment of the present invention with a telescopic upright column in a lowered position.
Figure 6:
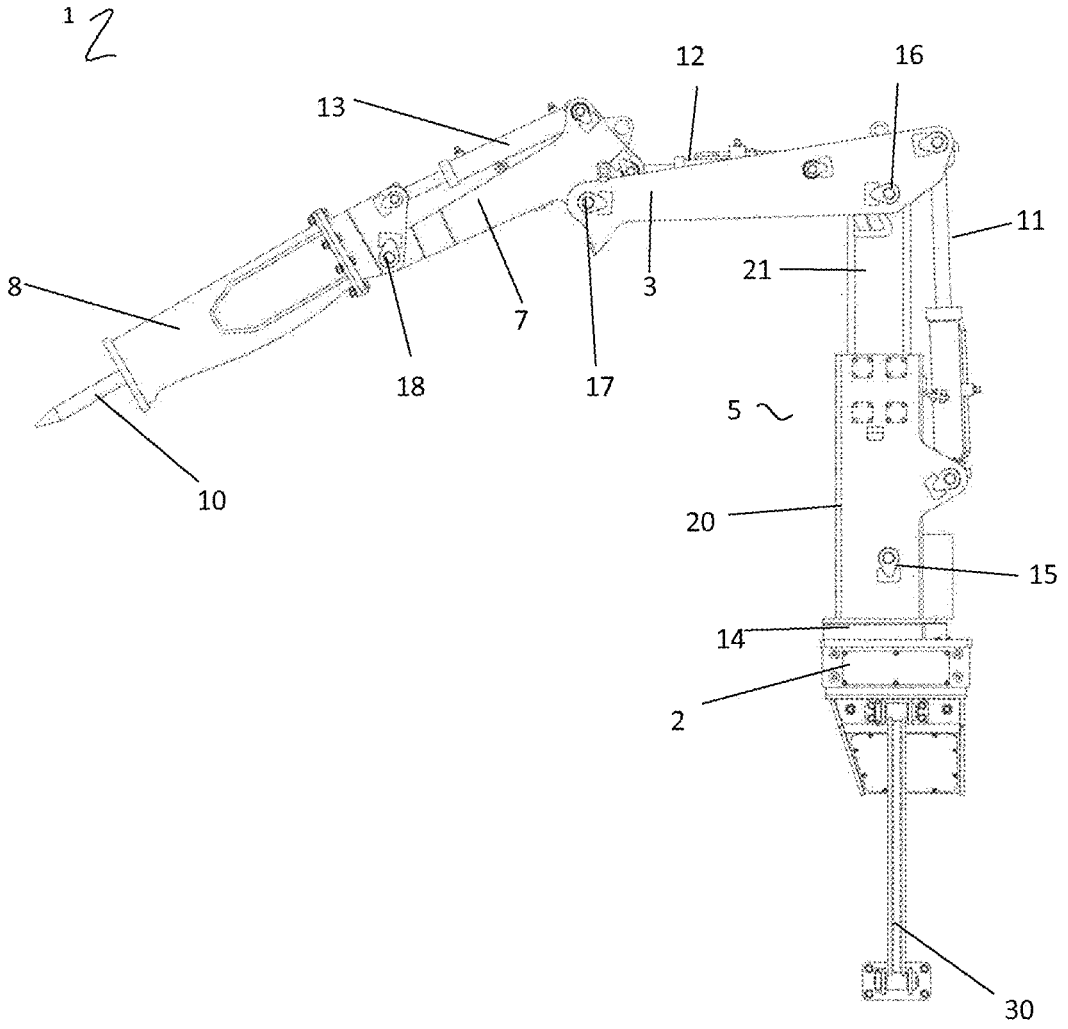
FIG. 6 is a lateral view of a boom system according to the first embodiment of the present invention with a telescopic upright column in an elevated position.
Figure 7:
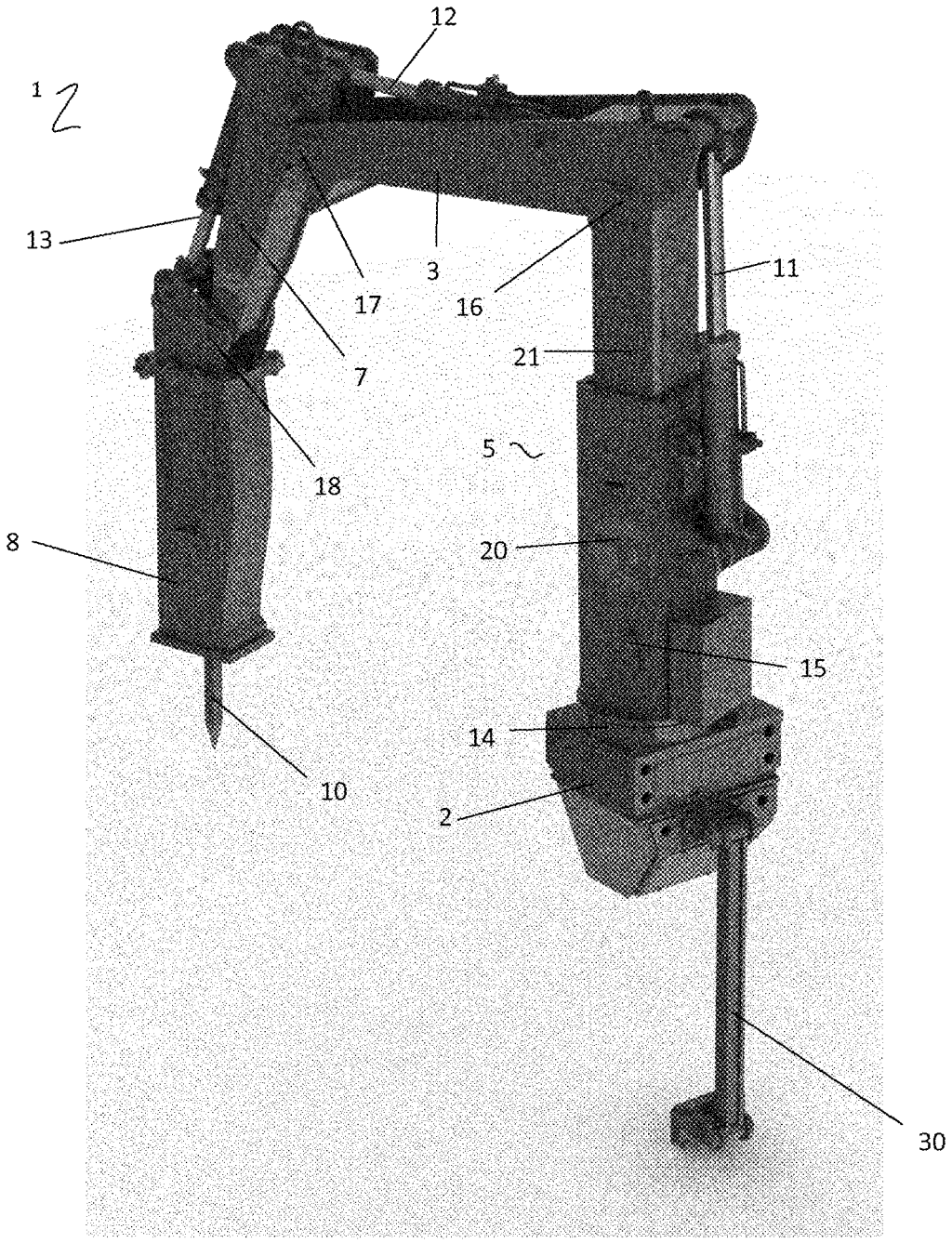
FIG. 7 is a perspective view of a boom system according to the first embodiment of the present invention with a telescopic upright column in an elevated position.

In the compact transport configuration, the connection 16 between the boom arm 3 and the upright column 5 is in its lower-most position (FIG. 5). Meanwhile, the connection 16 between the upright column 5 and the boom arm 3 is in its upper-most position when in the in-use configuration (for example as shown in FIGS. 1, 2, 6, 7 and 10). Further, in the in-use configuration, the moving arrangement 4 is adaptable to move the connection 16 between the boom arm 3 and the upright column 5 towards and away from the top of the upright wall 43 of the hopper 42. Furthermore, in the in-use configuration, the moving arrangement 4 is adaptable to move the connection 16 between the boom arm 3 and the upright column 5 to a position such that the boom system 1 is able to engage with oversize material. Further still, the in-use configuration, the moving arrangement 4 is adaptable to move the connection 16 between the boom arm 3 and the upright column 5 to be proximal to, level with, or above the top of the upright wall 43 of the hopper 42. Further still, in the in-use configuration, the moving arrangement 4 is adaptable to move the connection 16 between the boom arm 3 and the upright column 5 such that the boom arm 3 substantially or completely extends into the space above the hopper 42. Further still, in the in-use configuration, the moving arrangement 4 is adaptable to move the connection 16 between the boom arm 3 and the upright column 5 such that the boom arm 3 is able to extend substantially horizontally into the space above the hopper 42. Advantageously, the moving arrangement 4 enables the boom system 1 to adopt a compact transport configuration where it does not significantly increase the height or width of the vehicle 40 on which it is attached. During use, the moving arrangement 4 can raise the height of the boom system 1 such that all or a significant portion of the boom arm 3 extends into the work space. This provides the boom arm 3 with a greater range of motion than that of conventional mobile boom systems simply by moving the connection 16 between the boom arm 3 and the upright column 5 towards and away from the base 2 the upright column 5 is mounted on. The range of motion of the boom arm 3 can be further maximized by moving the connection point 16 between the boom arm 3 and the upright column 5 to be proximal to, level with, or above the top of the wall 43 of the hopper 42.

In one arrangement, the base 2 is integrally formed with the structural support frame of the vehicle 40 or hopper 42. In an alternative arrangement, the base 2 is fixedly or releasably coupleable to the vehicle 40 or hopper 42. Advantageously, this enables the boom system 1 to be removed from the vehicle 40 after use, such as for maintenance. The fixed or releasable coupling can be performed using a fastening arrangement (not shown), such as a mechanical fixing arrangement. Such mechanical fixing arrangements include bolted arrangements. It is generally desired in this alternative arrangement that the base 2 is mountable on the vehicle 40 without substantial modification to the vehicle.

The boom system 1 comprises one or more actuators (11, 12, 13) locatable on the outer side of the boom system 1 in use. The boom arm 3 is an actuatable boom arm 3. The boom system 1 further comprises a boom arm actuator 11 (FIGS. 1 to 10) for actuating the boom arm 3 relative to the upright column 5. The boom arm actuator 11 is connectable to the upright column 5 at or about one end and the boom arm 3 at or about the other end. The boom arm actuator 11 is locatable on the outer side of the boom system 1. In other words, the upright column 5 is disposed between the boom arm actuator 11 and the working area/and or tool 10 (FIGS. 1 to 10) in the in-use configuration. Advantageously, due to the more elevated position of the upright column 5 when in the in-use configuration, sufficient mechanical advantage for actuating the boom arm 3 relative to the upright column 5 can be provided by positioning the boom arm actuator 11 on the outer side of the boom system 1.

This reduces the risk of accidental contact between the boom arm actuator 11 and the wall of the hopper 42 and it also prevents chips, dust, dirt, grime and falling rock hitting against the boom arm actuator 11 during use. This reduces the risk of damage and down time.

The boom arm 3 is actuatable through an angle of up to 90 degrees with respect to the upright column 5. In some arrangements, the boom arm 3 is actuatable through an angle of up to 120 degrees with respect to the upright column 5. Advantageously, the moving arrangement 4 enables the upright column 5 to be in a more elevated position, while in the in-use configuration, than the columns used in conventional mobile boom systems whilst still maintaining the compact transport configuration. In the in-use configuration, the connection 16 between the upright column 5 and the boom arm 3 can be close to, level with, or extend above the wall 43 of the hopper 42 such that the boom arm 3 extends into the space above the grizzly 41. This is because the connection 16 between the upright column 5 and the boom arm 3 is movable towards and away from the top of the wall 43 of the hopper 42. In this situation, the boom arm 3 can be actuatable through an angle of up to 90 degrees or more with respect to the upright column 5 enhancing the range of motion of the boom system 1.

The boom arm actuator 11 is a telescopic actuator 11, an extensible and retractable ram 11, a pressure-fluid operated ram 11, or a hydraulic ram 11. Alternatively, the boom arm actuator 11 is driven by a motor or screw worm (not shown).

The boom system 1 further comprises a dipper arm 7 (FIGS. 1 to 10) connectable to the boom arm 3. Further, the boom system 1 comprises a tool head 8 (FIGS. 1 to 10) connectable to the dipper arm 7. The dipper arm 7 is pivotally coupleable to the tool head 8 at connection point 18. The dipper arm 7 is pivotally coupleable to the boom arm 3 at connection point 17. The boom arm 3 is indirectly connectable to the tool head 8 via the dipper arm 7.

The dipper arm 7 is an actuatable dipper arm 7. The actuation is provided by a dipper arm actuator 12 (FIGS. 1 to 10) for actuating the dipper arm 7 relative to the boom arm 3. The dipper arm actuator 12 is connectable to the boom arm 3 at or about one end and the dipper arm 7 at or about the other end. The dipper arm actuator 12 is locatable on the outer side of the boom system 1 in use. Advantageously, having the dipper arm actuator 12 on the outer side of the boom system 1 reduces the risk of accidental contact between the dipper arm actuator 12 and the wall of the hopper, a common source of damage to the actuators in conventional boom systems. Further, it also prevents or reduces the likelihood of chips, dust, dirt, grime and/or falling rock hitting against the dipper arm actuator 12 during use. As a consequence, the above arrangement reduces the risk of damage to the boom system 1 and down-time.

The dipper arm 7 is actuatable through an angle of up to 90 degrees with respect to the boom arm 3. In some arrangements, the dipper arm 7 is actuatable through an angle of up to 120 degrees with respect to the boom arm 3.

The dipper arm actuator 12 is a telescopic actuator 12, an extensible and retractable ram 12, a pressure-fluid operated ram 12, or a hydraulic ram 12. Alternatively, the dipper arm actuator 12 is driven by a motor or screw worm (not shown).

The tool head 8 is an actuatable tool head 8. The boom system 1 further comprises a tool head actuator 13 for actuating the tool head 8 relative to the dipper arm 7. The tool head actuator 13 is connectable to the dipper arm 7 at or about one end and the tool head 8 at or about the other end. The tool head actuator 13 is locatable on the outer side of the boom system 1 in use. Advantageously, having the tool head actuator 13 on the outer side of the boom system 1 reduces the risk of accidental contact between the tool arm actuator 13 and the wall of the hopper, a common source of damage to the actuators in conventional boom systems. Further, it also prevents or reduces the likelihood of chips, dust, dirt, grime and/or falling rock hitting against the tool head actuator 13 during use. As a consequence, the above arrangement reduces the risk of damage to the boom system 1 and down-time.

The tool head 8 is actuatable through an angle of up to 90 degrees with respect to the dipper arm 7. In some arrangements, the tool head 8 is actuatable through an angle of up to 120 degrees with respect to the dipper arm 7.

The tool head actuator 13 is a telescopic actuator 13, an extensible and retractable ram 13, a pressure-fluid operated ram 13, or a hydraulic ram 13. Alternatively, the tool head 13 actuator is driven by a motor or screw worm.

The tool head 8 is adaptable for breaking and/or manoeuvring oversize material. The tool head 8 comprises an actuatable hammer 10 (FIGS. 1 to 10) for this purpose. The actuatable hammer 10 can be a hydraulic hammer 10. The tool head 8 can alternatively or additionally comprise a vibrating poker (not shown).

The boom system 1 can further comprises a rotating arrangement 14 for rotating the upright column 5, such as about the vertical axis. The rotating arrangement 14 can comprise a slewing system 14 (FIGS. 1 to 10) which can be operably coupled to or part of the base 2. The slewing system 14 is adaptable to rotate the upright column 5 about the vertical axis by up to 180 degrees, and most likely up to 360 degrees. The slewing system 14 comprises a slew-ring and pinion (not shown).

In an alternative arrangement, the rotating arrangement 14 comprises a gear on gear arrangement for rotating the upright column 5.

In a further alternative arrangement, the rotating arrangement 14 comprises at least one telescopic actuator for rotating the upright column 5. The at least one telescopic actuator is an extensible and retractable ram, pressure-fluid operated ram or a hydraulic ram. Alternatively, the telescopic actuator is driven by a motor or screw worm.

The boom system 1 further comprises a power supply (not shown) for driving the boom system 1. The power supply is integral with the boom system 1. The power supply can be a hydraulic power supply.

FIGS. 1 to 7 provide an example boom system 1 according to a first embodiment of the present invention. In this embodiment, the upright column 5 is a length adjustable upright column 5. The moving arrangement 4 (FIGS. 1 and 3) comprises a drive arrangement 4 to increase/decrease the length of the length adjustable upright column 5, and therefore move the boom arm 3 upwards/downwards, generally in the vertical direction. Therefore, the length adjustable upright column 5 is moveable between a retracted configuration and an extended configuration. In the retracted configuration the length adjustable upright column 5 has a height in the range of 80 cm to 120 cm, and most likely 110 cm. In the extended configuration the length adjustable upright column 5 has a height in the range of 110 cm to 180 cm, and most likely 150 cm. The arrangement shown in FIGS. 1-7, the length adjustable upright column 5 is a telescopic upright column 5. The telescopic upright column 5 comprises an external upright column 20 (FIGS. 1 to 7) fixedly mounted to the base 2. An internal upright column 21 (FIGS. 1 to 7) is moveably received in the external upright column 20 and adaptable to move towards and away from the base 2. The connection 16 between the boom arm 3 and the upright column 5 is located at or about the top of the internal upright column 21.

The drive arrangement 4 is adaptable to move the internal upright column 21 relative to the external upright column 20 such that the connection 16 between the boom arm 3 and the upright column 5 is moveable towards and away from the base 2. The drive arrangement 4 is located within the length adjustable or telescopic upright column 5. Advantageously, having the drive arrangement 4 locatable within the length adjustable or telescopic upright column 5 reduces the likelihood of chips, dust, dirt, grime and/or falling rock hitting against the drive arrangement 4 during use. As a consequence, the above arrangement reduces the risk of damage to the boom system 1 and down-time.

The drive arrangement 4 comprises at least one actuator 4 having a first end portion connectable to the external upright column 20 or base, for example at connection point 15, and a second end portion connectable to the internal upright column 21, for example at or about connection point 16.

The at least one actuator 4 of the drive arrangement is a telescopic actuator 4, extensible and retractable ram 4, pressure-fluid operated ram 4, or hydraulic ram 4. Alternatively, the drive arrangement 4 is driven by motor or screw worm.

When the at least one actuator 4 is an extensible and retractable ram, the ram 4 is extended when the boom system 1 is in the in-use configuration and retracted when the boom system 1 is in the transport configuration.

In this first embodiment, the base 2 can further comprise a bracing arrangement 30 for structurally supporting the boom system 1 when in use.

Figure 8:
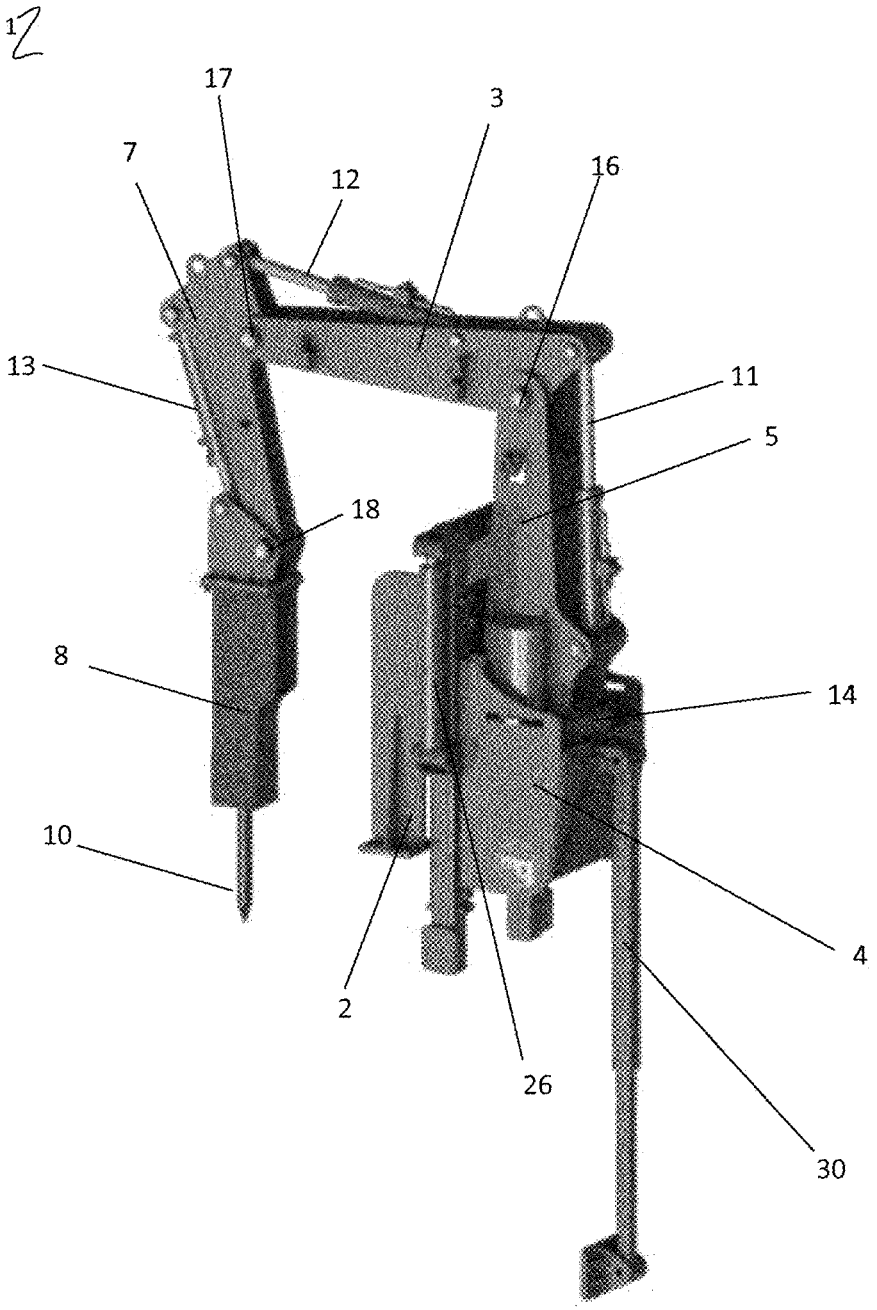
FIG. 8 is a perspective view of a boom system according to a second embodiment of the present invention.
Figure 9:
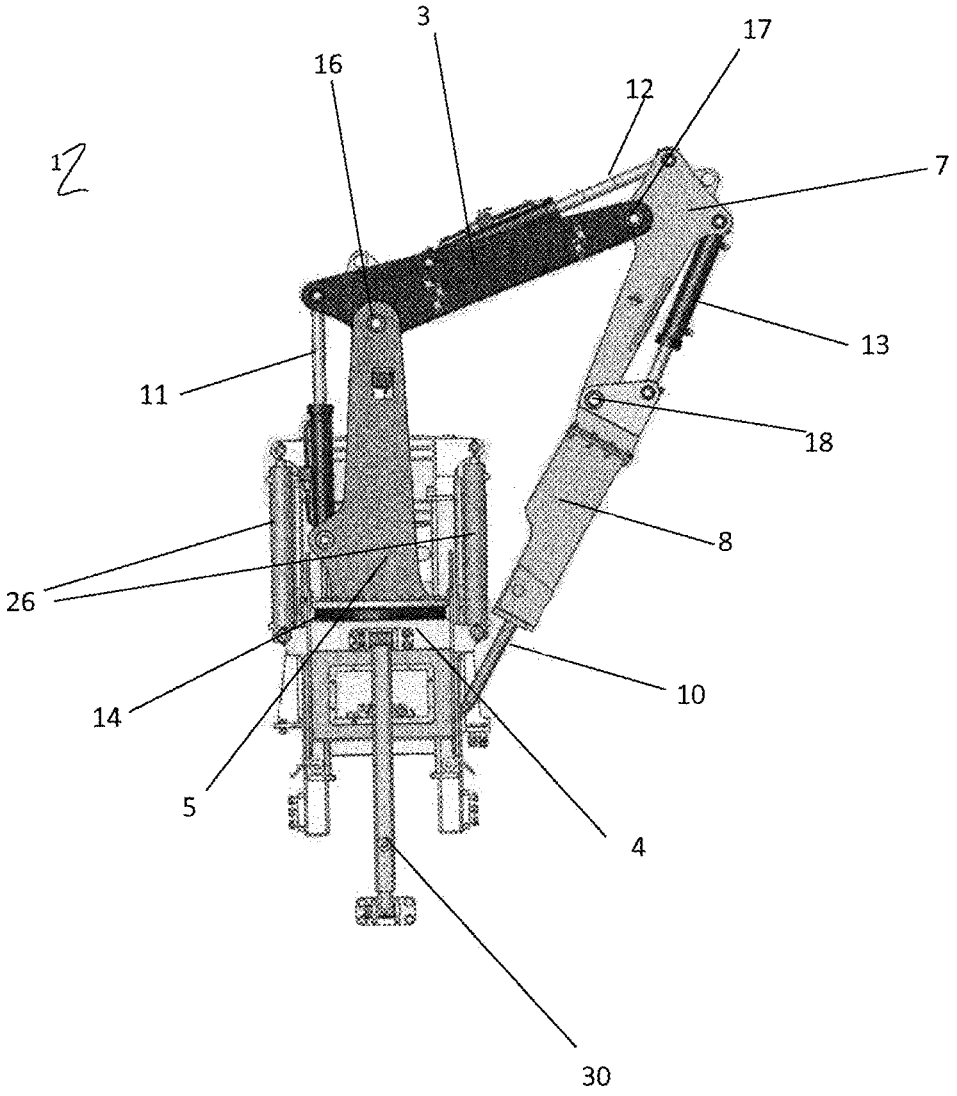
FIG. 9 is a lateral view of a boom system according to the second embodiment of the present invention.
Figure 10:
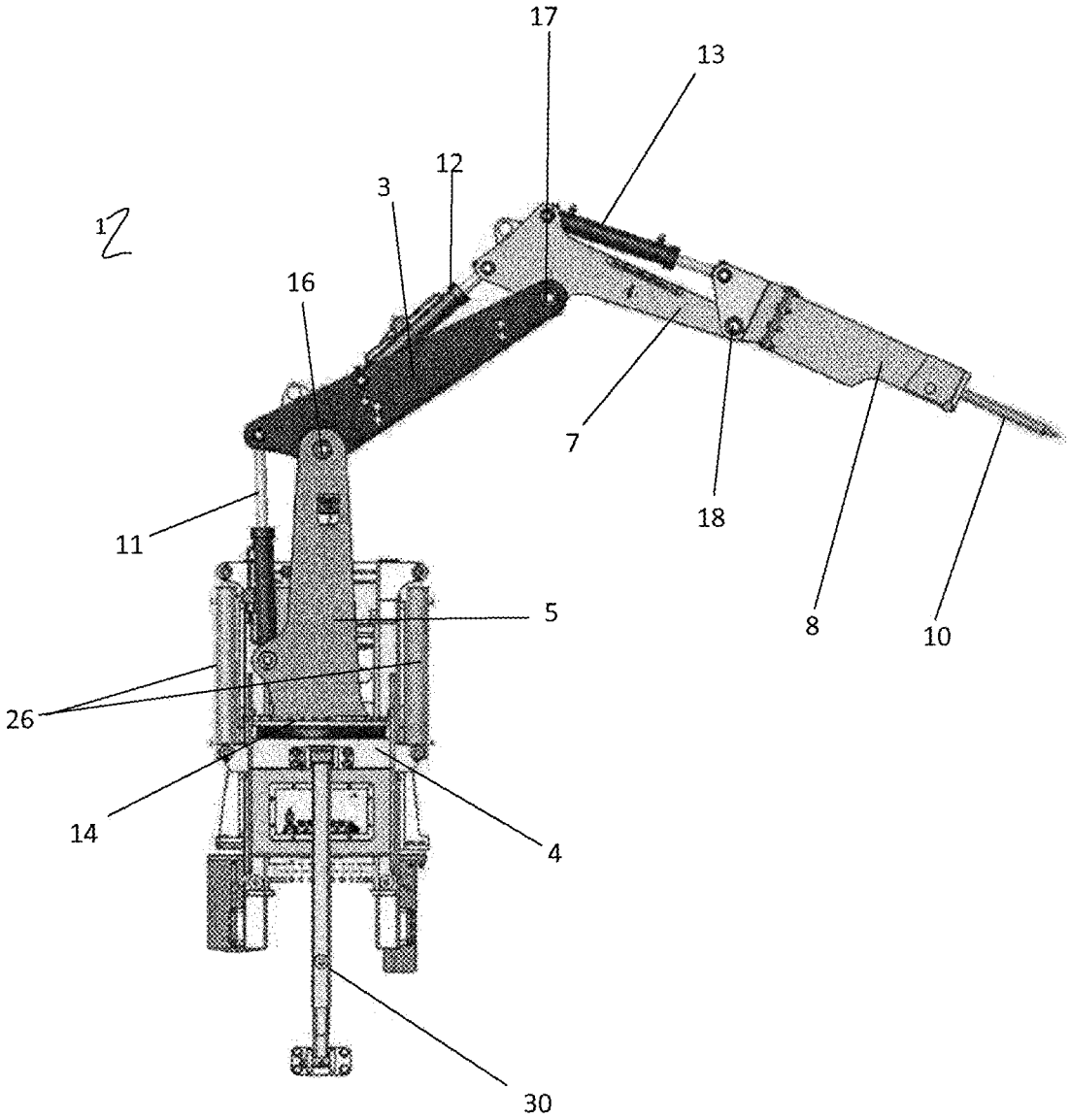
FIG. 10 is another lateral view of a boom system according to the second embodiment of the present invention.

FIGS. 8 to 10 provide an example boom system 1 according to a second embodiment of the present invention. In this embodiment, the moving arrangement 4 comprises a moveable platform 4 moveably mountable to the base 2 and fixedly mountable to the upright column 5. The upright column 5 is fixedly coupleable to the moveable platform 4 and pivotally coupleable to the boom arm 3. The boom arm 3 is connectable to the moveable platform 4 via the upright column 5. The moveable platform 4 is moveable relative to the base 2 that the moveable platform 4 is mounted on so that the connection 16 between the upright column 5 and the boom arm 3 is moveable towards and away from the base 2.

The movable platform 4 is moveably mounted on the base 2 by a drive arrangement 26. The drive arrangement 26 comprises at least one actuator 26, telescopic actuator 26, extensible and retractable ram 26, pressure-fluid operated ram 26 or hydraulic ram 26. Alternatively, the drive arrangement 26 is driven by a motor or screw worm (not shown).

The at least one actuator 26 is connectable to the moveable platform 4 at or about one end and the base 2 at or about the other end. The moveable platform 4 is moveable on the base 2, and can be slideably moveable on the base 2. In most arrangements, a lower end of the at least one actuator 26 is connectable to the moveable platform 4 and an upper end of the at least one actuator 26 is connectable to the base 2.

In arrangements where the at least one actuator 26 is an extensible and retractable ram 26, the ram 26 will be retracted when the boom system 1 is in the in-use configuration and extended when the boom system 1 is in the transport configuration.

The upright column 5 has a height in the range of 80 cm to 120 cm, and most likely a height of 110 cm. The moveable platform is moveable through a range of 30 cm to 60 cm, and most likely through a range of 40 cm.

In most arrangements, the drive arrangement 26 comprises two actuators 26 positioned at opposite lateral sides of the moveable platform 4. Each actuator 26 is connectable to the moveable platform 4 at or about one end and the base 2 at or about the other end. The lower ends of the two actuators 26 can be connectable to the moveable platform 4 and upper ends of the two actuators 26 can be connectable to the base 2. Further, in arrangements where the two actuators 26 are extensible and retractable rams 26, the rams 26 will be retracted when the boom system 1 is in the in-use configuration and extended when the boom system 1 is in the transport configuration.

The moveable platform 4 further comprises a telescopic bracing arrangement 30 for structurally supporting the boom system 1 when in-use. The telescopic bracing arrangement 30 extends from the moveable platform 4 and is connectable to the vehicle on which the boom system 1 is optionally mounted to. The telescopic bracing arrangement 30 increases/decreases in length with the movement of the moveable platform 4.

The base 2 of the boom system 1 is a frame 2. A fastening arrangement (not shown) is provided to fasten the frame the vehicle.

In a third embodiment not expressly shown in the Figures, the boom system 1 comprises a combination of the first and second embodiments outlined above. The moving arrangement 4 of this embodiment comprises a moveable platform 4 moveable mountable to the base 2 and fixedly mountable to the upright column 5. The moveable platform 4 is moveable relative to the base 2 that the moveable platform 4 is mounted on so that the connection 16 between the upright column 5 and the boom arm 3 is moveable towards and away from the base 2. In addition, the upright column 5 is a length adjustable upright column 5, and the moving arrangement 4 further comprises a drive arrangement 4 to increase/decrease the length of the length adjustable upright column 5, and therefore move the boom arm 3 upwards/downwards. It can be appreciated that any of the features described above, such as in relation to the first and second embodiments, can be applied to the third embodiment.

Figure 11:
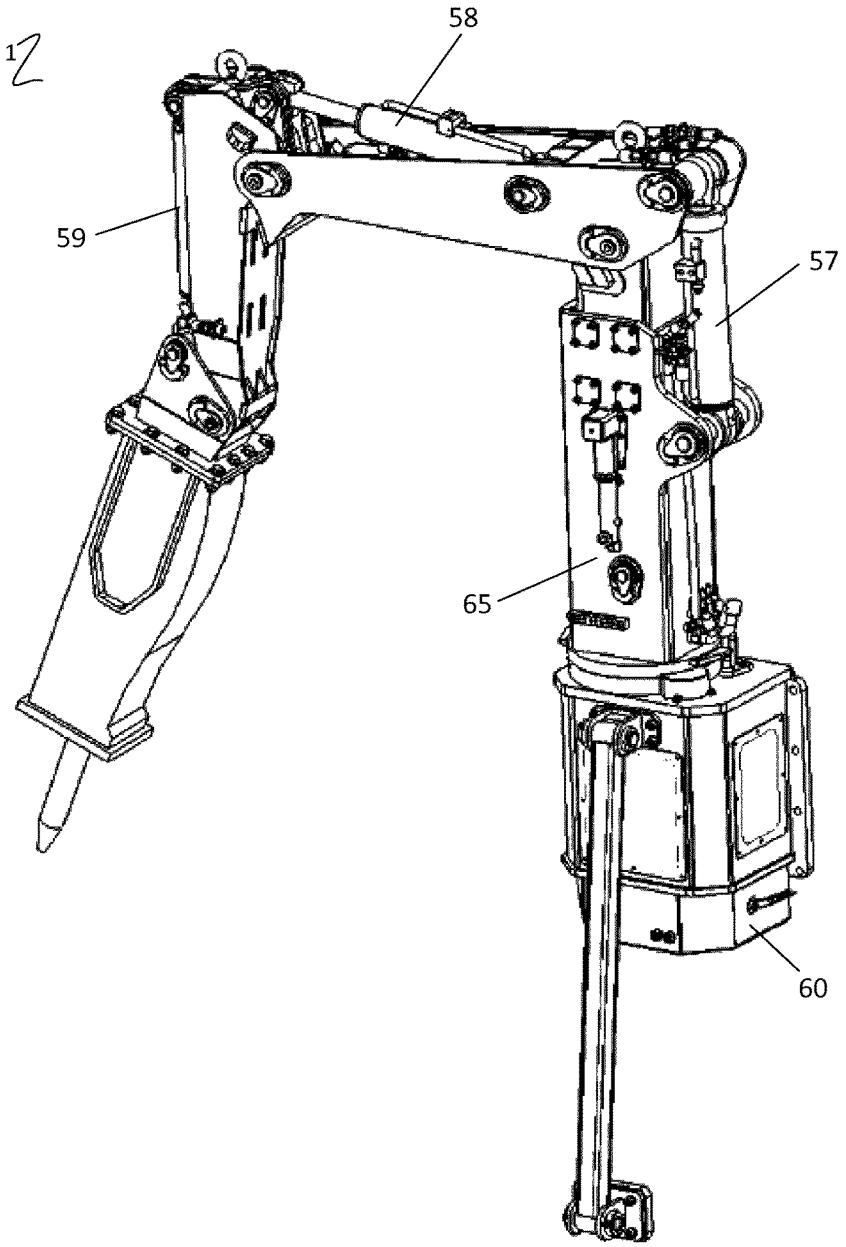
FIG. 11 is a perspective view of a further embodiment of boom system.
Figure 12:
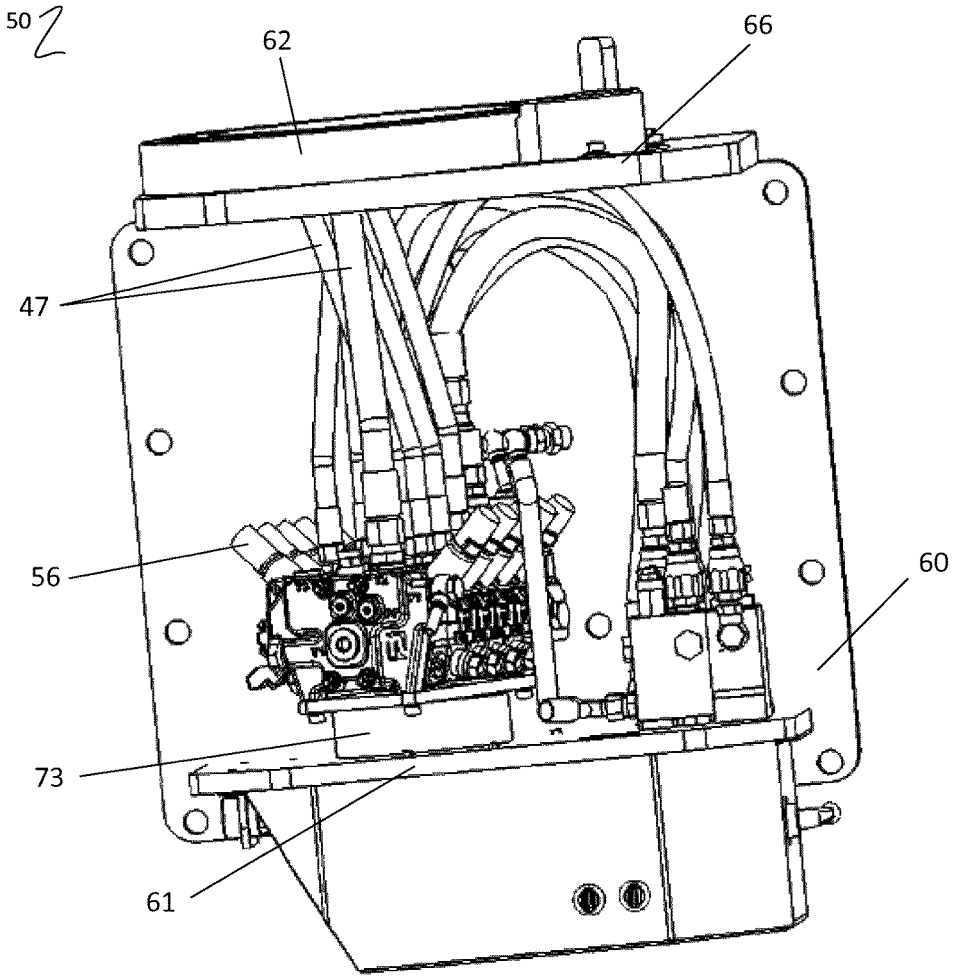
FIG. 12 is a perspective view of a base of the boom system with two walls of the base removed to illustrate internal features.
Figure 13:
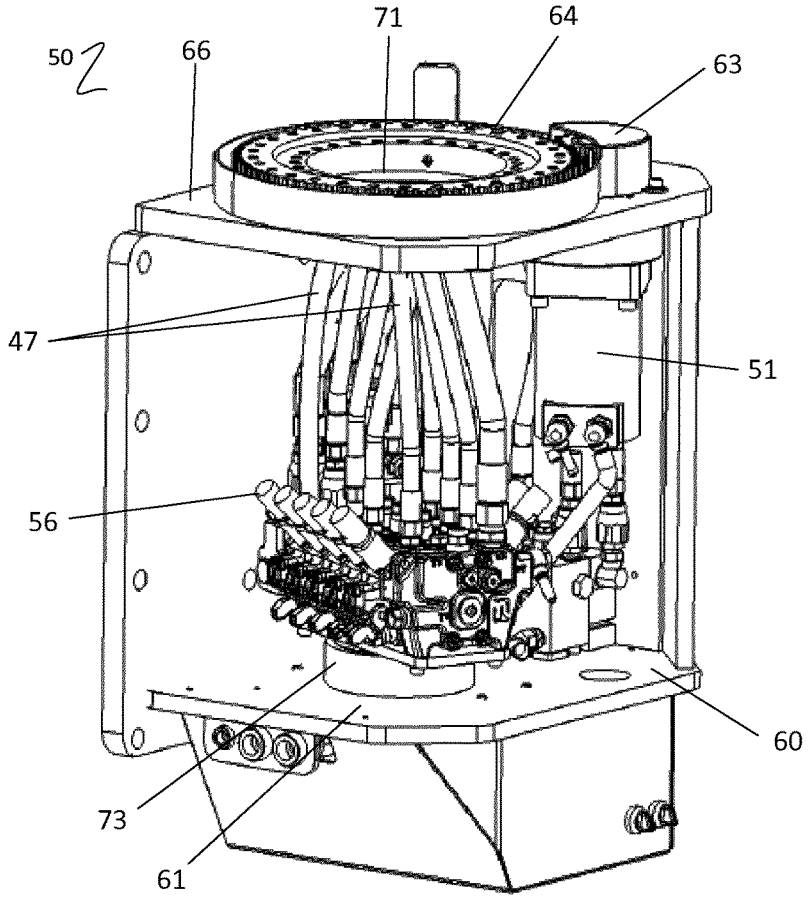
FIG. 13 is a perspective view of the base of the present invention with a number of the walls removed to illustrate internal features.
Figure 14:
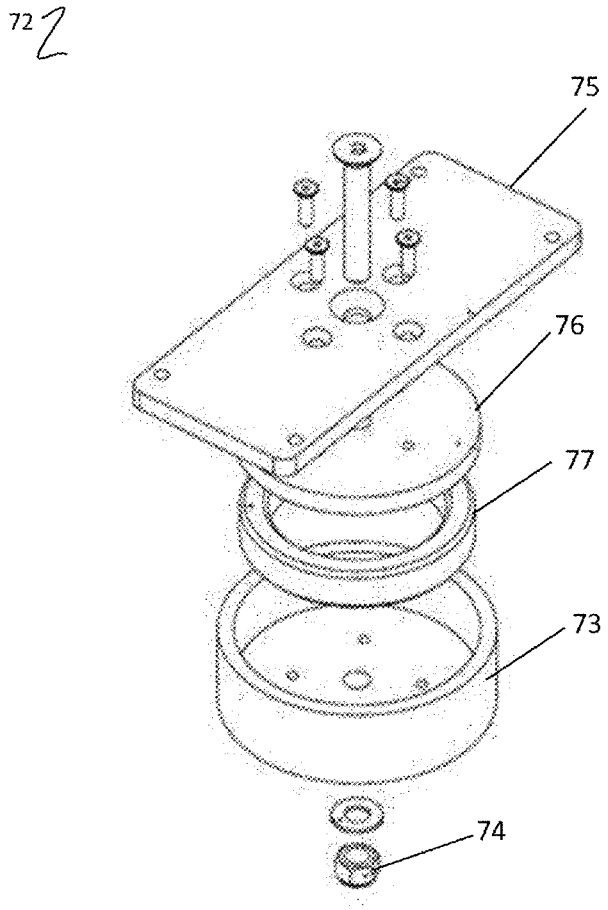
FIG. 14 is an exploded view of a rotatable assembly for a valve bank.
Figure 15:
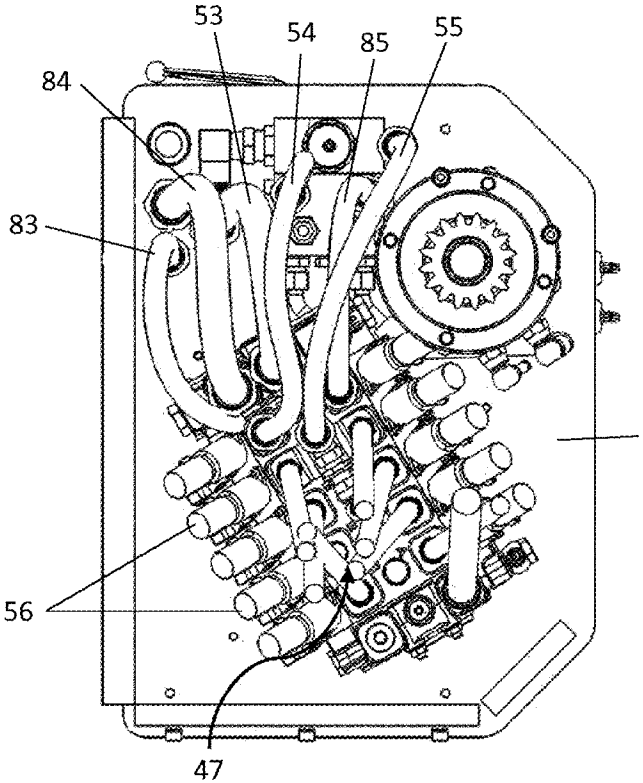
FIG. 15 is a top plan view of the internal structure of the base illustrating the angular orientation of the valve bank.

Referring to the drawings and now to FIGS. 11 to 20, the power supply system indicated generally by reference numeral 50 of the boom system 1 comprises a motor 51 for driving a working fluid being a hydraulic fluid and a working fluid delivery arrangement 53, 54, 55, 83, 84 and 85 see FIG. 15 and an arrangement 56 for diverting the working fluid from the fluid delivery arrangement 53, 54, 55, 83, 84 and 85 to one or more actuators 57, 58, 59 see FIG. 11 powered by the working fluid. The working fluid diverting arrangement 56 comprises a valve bank 56 for diverting the working fluid to one or more actuators 57, 58 and 59 of the boom system 1. The valve bank 56 comprises fluid delivery conduits 47 for diverting the working fluid to the one or more actuators 57 to 59. The valve block 56 is mounted within base 60. The base 60 has a housing having a floor 61 and a top wall 66 formed for receiving a rotary actuator 62. The rotary actuator 62 comprises a pinion 63 directly driven by the motor 51 and slew ring 64 driven by the pinion 63.

Advantageously, having the valve bank 56 within the base 60 reduces the likelihood of chips, dust, dirt, grime and/or falling rock hitting against this valve bank 56 during use. As a consequence, the above arrangement reduces the risk of damage to the valve bank 56 and down-time. Furthermore, there is a reduced risk of corrosion to this valve bank 56 when it is housed within the base 60. The valve bank 56 which is mounted within the base 60 is movably mounted within the base 60. The valve bank 56 which is mounted within the base 60 is movably mounted within the base 60 below the rotary actuator 62 for moving the upright column 65 relative to the base 60. The valve bank 56 which is mounted within the base 60 is movably mounted on the floor 61 of the base 60 below the rotary actuator 62 for moving the upright column 65 relative to the base 60 which is mounted on the top wall 66 of the base 60. The valve bank 56 is mounted within the base 60 and is rotatably mounted within the base 60. The valve bank 56 which is mounted within the base 60 is movably mounted within the base 60 so as to follow the movement of the upright column 65. The valve bank 56 which is mounted within the base 60 is rotatably mounted within the base 60 so as to follow the rotational movement of the upright column 65. The fluid delivery conduits 47 are operably coupled between the valve bank 56 which is mounted within the base 60 and the actuators 57 to 59. The rotary actuator 62 has a central aperture 71.

The fluid delivery conduits 47 are operably coupled between the valve bank 56 which is mounted within the base 60 and the actuators 57 to 59 extending via the central aperture 71 of the rotary actuator 62. The fluid delivery conduits 47 are hydraulic hoses. Advantageously, the rigid yet flexible and resilient nature of the hydraulic hoses 47 allow the hydraulic hoses to transmit the rotational forces acting on the hoses as a result of the upright column 65 rotating through to the valve bank 56 thereby causing the valve bank 56 to rotate with the rotation of the upright column 65. The valve bank 56 which is mounted within the base 60 is mounted on a rotating assembly 72. The rotating assembly 72 has a housing pipe 73 mounted on the floor of the base 60 via fasteners 74. A valve bank mounting plate 75 is provided on which the valve bank 56 is mounted and the valve bank mounting plate 75 is in turn mounted on turntable mounting plate 76 which sits on the bearing 77 allowing the valve bank 56 to rotate under the influence of the rotating hydraulic hoses 47.

The axis of rotation of the rotating assembly 72 of the valve bank 56 which is mounted within the base 60 and the axis of rotation of the rotary actuator 62 for rotating the upright column 65 relative to the base 60 can be vertically aligned in use. Advantageously, this reduces the forces acting on the hydraulic hoses 47 as the hydraulic hoses 47 pass through the central aperture 71 of the rotary actuator 62 and extend down through the base 60 to the rotating assembly 72 thereby making the force transmission as efficient and aligned as possible by the central positioning of the hydraulic hoses 47.

The hydraulic hoses 47 are spaced radially outwardly from the axis of rotation of the rotating assembly 72 of the valve bank 56 which is mounted within the base 60. Advantageously, this allows the hydraulic hoses 47 to apply a torque to the rotating assembly 72 as the hydraulic hoses 47 are rotated as a result of upright column rotation. The hydraulic hoses 47 are angularly spaced around the axis of rotation of the rotating assembly 72 of the valve bank 56 which is mounted within the base 60. Advantageously, this allows the hydraulic hoses 47 to apply a torque to the rotating assembly 72 as the hydraulic hoses 47 are rotated as a result of upright column rotation.

Figure 17:
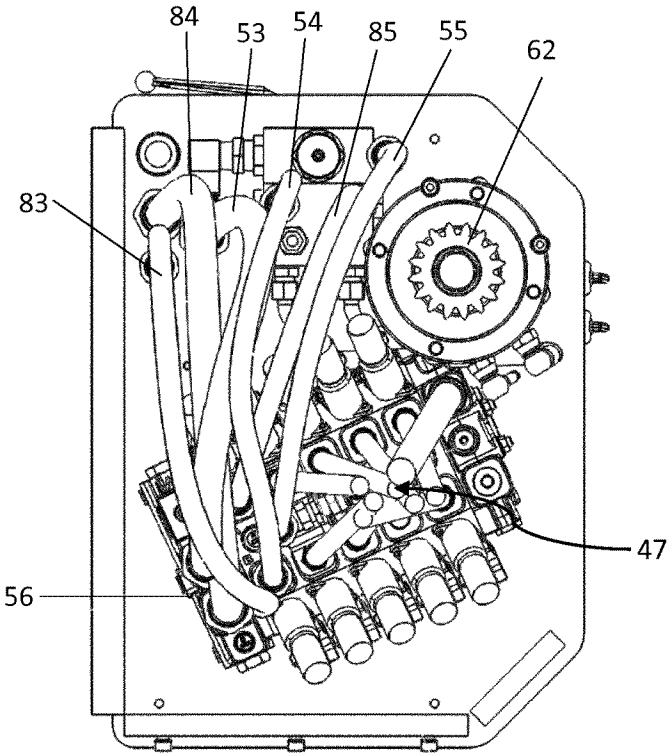
FIG. 17 is a second top plan view of the internal structure of the base illustrating a second angular orientation of the valve bank.

The working fluid delivery arrangement 53, 54, 55, 83, 84 and 85 see FIGS. 15 and 17 is operably coupled between a fixed part of the base 60 and the valve bank 56 which is movably mounted within the base 60. Therefore both ends of each of the hydraulic hoses making up working fluid delivery arrangement 53, 54, 55, 83, 84 and 85 are movably coupled to the fixed part of the base 60 and movably coupled to a port of the valve bank 56 which is movably mounted within the base 60. The working fluid delivery arrangement 53, 54, 55, 83, 84 and 85 is hydraulic hoses 53, 54, 55, 83, 84 and 85 movably coupled between a fixed part of the base 60 and a port of the valve bank 56 which is movably mounted within the base via swivel fittings 81 on each end of the hydraulic hoses 53, 54, 55, 83, 84 and 85. Advantageously, this allows the valve bank 56 which is movably mounted within the base 60 to rotate without the hydraulic hoses 53, 54, 55, 83, 84 and 85 loosening. The working fluid delivery arrangement 53, 54, 55, 83, 84 and 85 comprise a feed 53, return 84 and bleed hydraulic hose 83 as well as a motor pump supply 54 and return hydraulic hose 85. A diverter valve supply as a CETOP valve supply 55 is also provided to supply working fluid to the upright column actuator and an actuator for a mechanical lock see FIGS. 21 to 25. The fluid delivery conduits 47 are operably coupled to the tool head actuator 59, the dipper arm actuator 58 and the boom arm actuator 57. The fluid delivery conduits 47 are hydraulic hoses operably coupled between valve bank 56 which is movably mounted within the base 60 and the tool head actuator 59, the dipper arm actuator 58 and the boom arm actuator 57.

Figure 16:
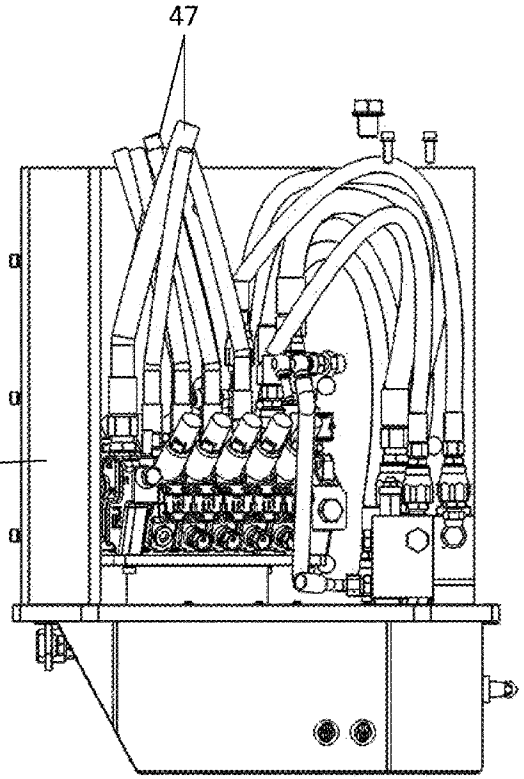
FIG. 16 is a front elevation view of FIG. 15.
Figure 18:
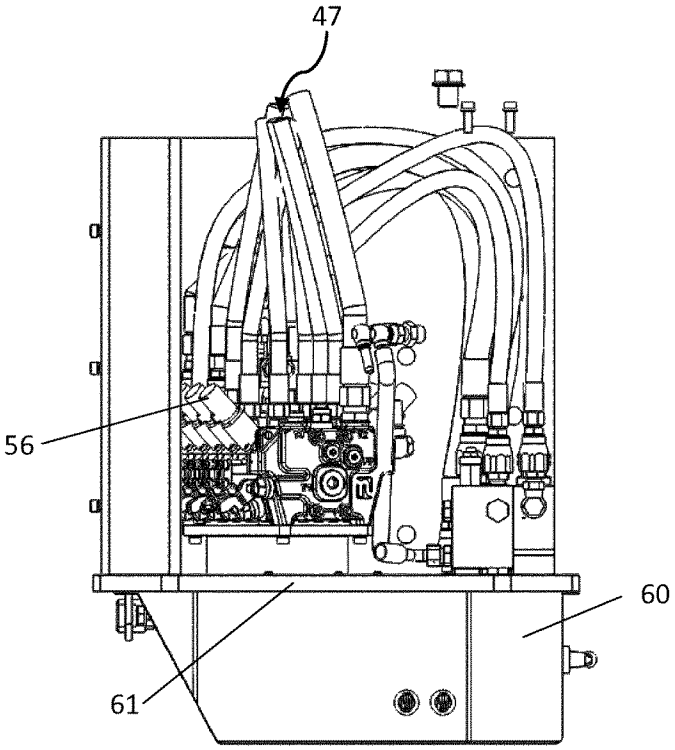
FIG. 18 is a front elevation view of FIG. 17.
Figure 20:
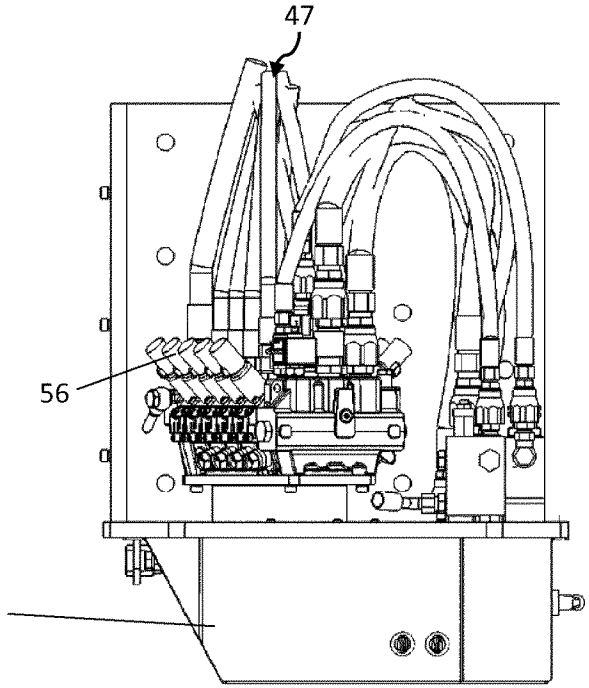
FIG. 20 is a front elevation view of FIG. 19.
Figure 19:
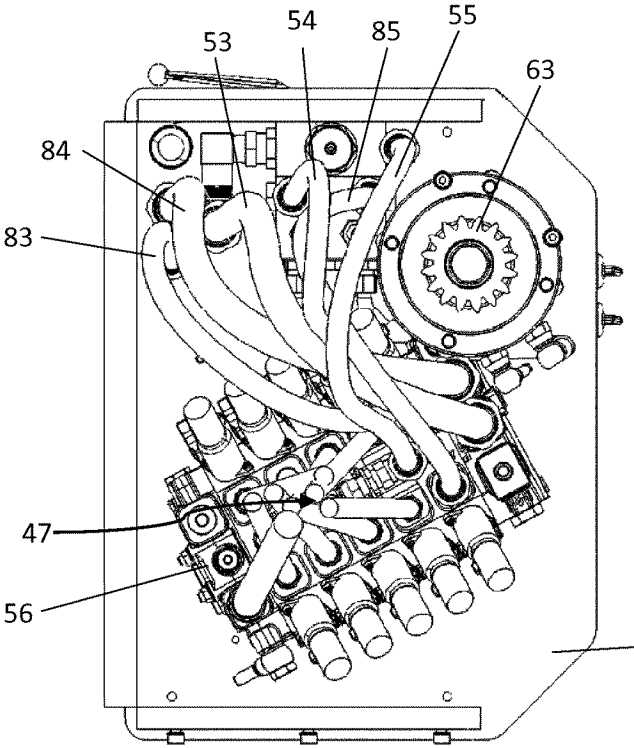
FIG. 19 is a third top plan view of the internal structure of the base illustrating a third angular orientation of the valve bank.
Figure 21:
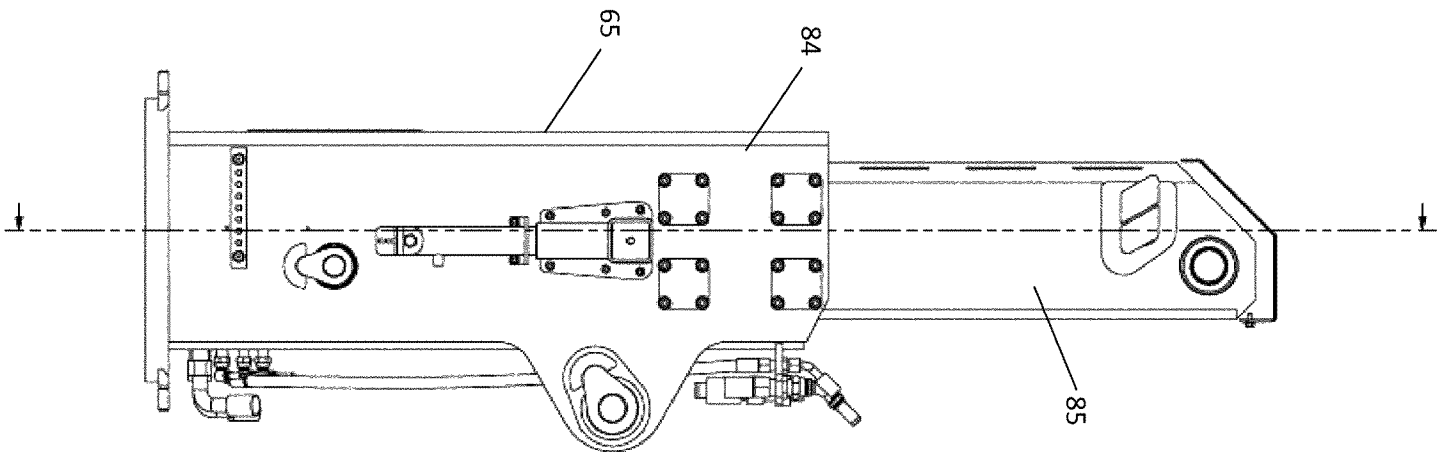
FIG. 21 is a front plan view of the upright column.
Figure 22:
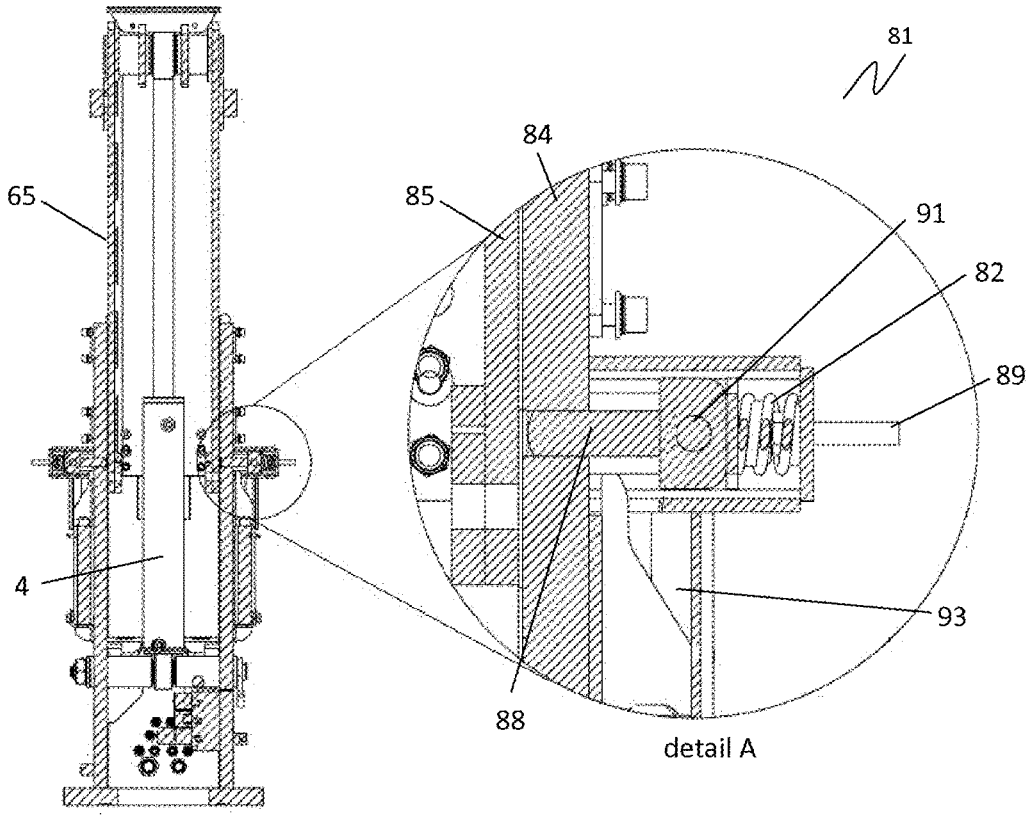
FIG. 22 is a section view through the upright stand with a detail view showing the mechanical lock.
Figure 23:
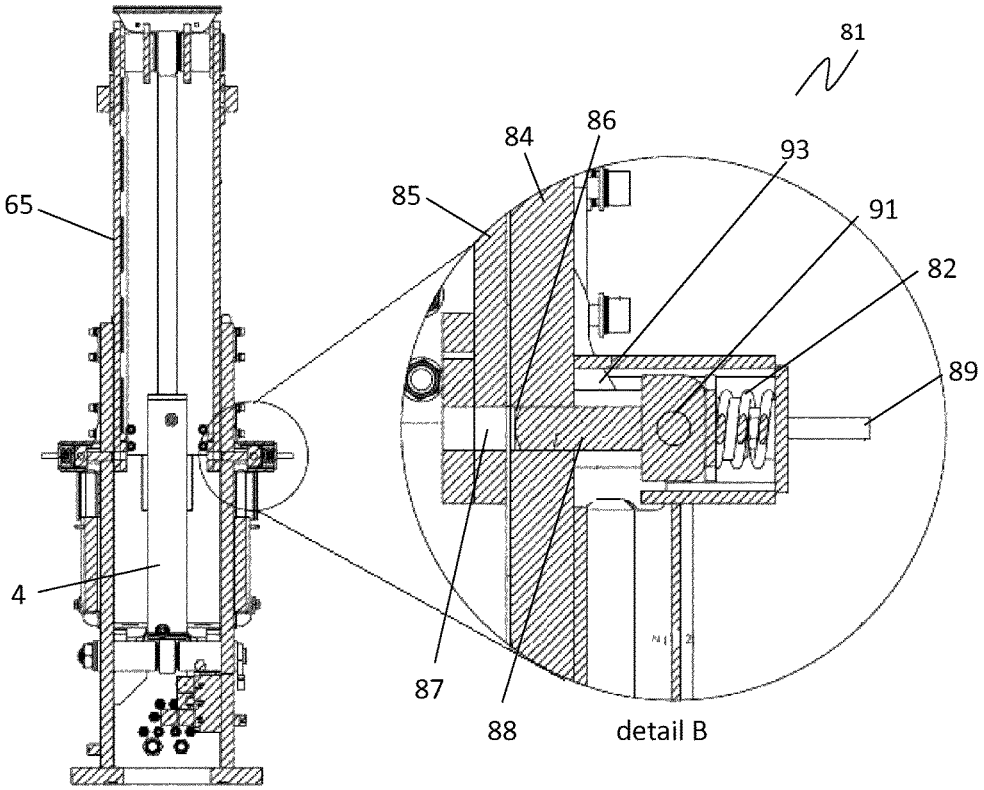
FIG. 23 is a section view through the upright stand at a second extension of the upright stand with a detail view showing the mechanical lock.

In the drawings, FIGS. 15 and 16 show the valve block 56 in a neutral axis where no rotation of the upright column 65 has taken place. FIGS. 17 and 18 show the valve block 56 rotated 90 degrees anticlockwise following rotation of the upright column 65 by 90 degrees anticlockwise. FIGS. 19 and 20 show the valve block 56 rotated 90 degrees clockwise following rotation of the upright column 65 by 90 degrees clockwise.

Figure 24:
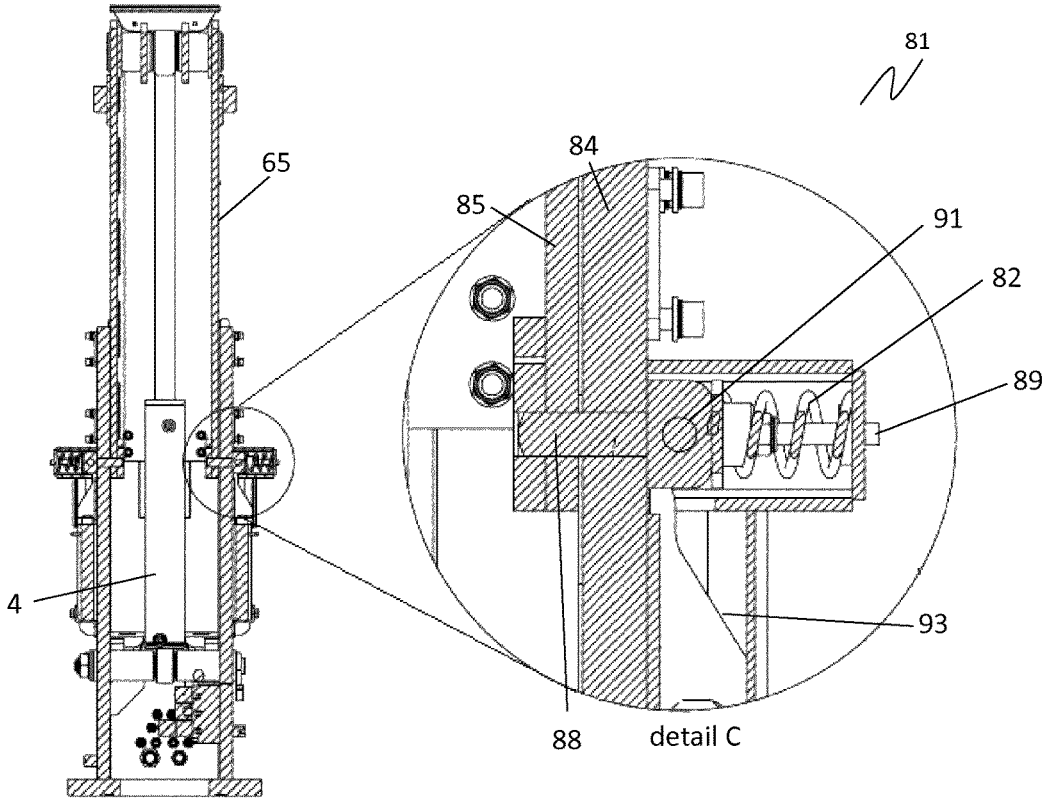
FIG. 24 is a section view through the upright stand at a third extension of the upright stand with a detail view showing the mechanical lock.
Figure 25:
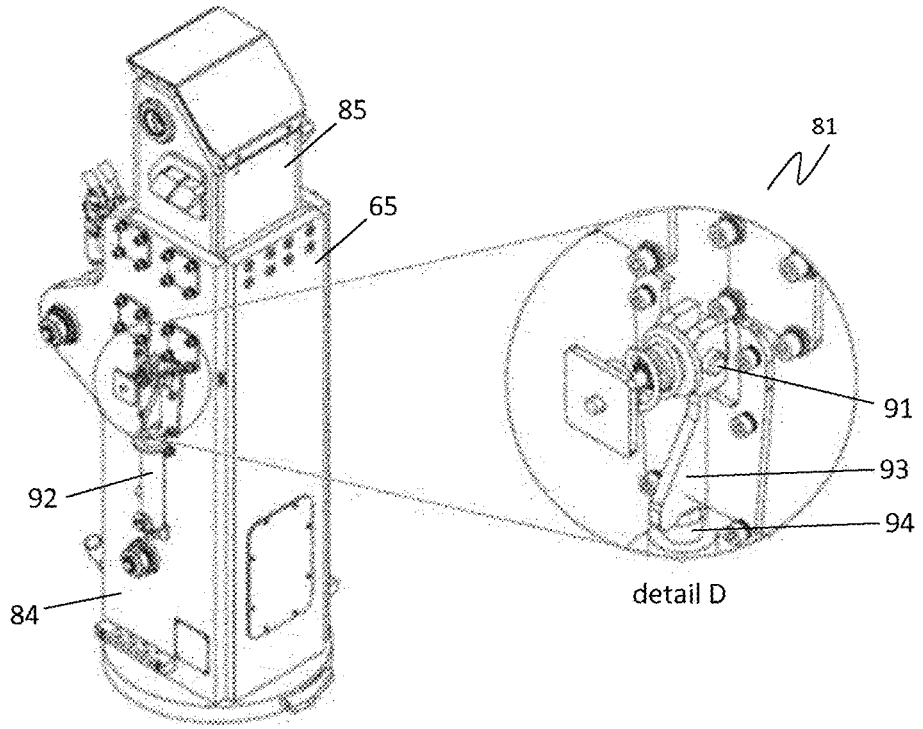
FIG. 25 is a perspective view of the upright column with a detail view showing the mechanical lock.

Referring to the drawings and now to FIGS. 21 to 25 there is shown the upright column 65 having a mechanical lock 81 for locking the upright column 65 in the extended configuration see FIG. 24. The mechanical lock 81 is normally biased into a locking position via biasing member 82 when the upright column 65 is in the extended configuration. The external upright column 84 and the internal upright column 85 each have an aperture 86, 87 respectively see FIG. 23 extending through a wall of each column 84, 85 at a location so that the apertures 86, 87 align when the upright column 65 is in the extended configuration for receiving a locking pin 88 of the mechanical lock 81.

The locking pin 88 of the mechanical lock 81 extends laterally through both the external upright column 84 and the internal upright column 85 physically locking them in the extended configuration when the locking pin 88 is biased into the locking position by biasing member 82. The mechanical lock 81 is mounted on the outside of the external upright column 84 with the locking pin 88 in alignment and inserted into the locking aperture 86 of the external upright column 84 with the leading end of the locking pin 88 abutting against the corresponding wall of the internal upright column 85 see FIG. 22 detail A under a biasing force of the biasing member 82 until the locking aperture 87 of the internal upright column 85 aligns with the aperture 86 of the external upright column 84. There is a mechanical lock 81 on at least two opposite sides of the upright column 65. The biasing member 82 acts on the trailing end of the locking pin 88. The locking pin 88 has a visual indicator 89 for indicating that the locking pin 88 is in an upright column locking position see FIG. 24, Detail C or an upright column releasing position see FIGS. 22,23 Detail A and Detail B respectively. The visual indicator 89 is a lengthwise indicator protruding a particular distance out of the mechanical lock housing indicating a locked or released condition for the extendable upright column 65. This allows a machine operator to be satisfied that it safe to operate the boom system when the indicator informs the operator that the upright column 65 is securely locked.

The biasing member 82 is a spring, most preferably a helical spring. The locking pin 88 has an actuating member 91 protruding laterally from the locking pin 88 so as to be engageable with an actuator 92 for retracting the locking pin 88 out of the locking aperture 87 of the internal upright column 85 against the biasing force of the biasing member 82.

The actuator 92 has a wedge 93 mounted on a ram 94, preferably hydraulic in such a way that the wedge 93 is slidable between the outside surface of the external upright column 84 and the actuating member 91 of the locking pin 88 for forcing the locking pin 88 out of the aperture 87 of the internal upright column 85 overcoming the biasing force of the biasing member 82 thereby releasing the upright column 65 from the extended position.

The actuating member 91 of the locking pin 88 is a hard steel bush. Advantageously, this reduces friction during activation of the lock 81 and reduces wear on the wedge 93.

Figure 26:
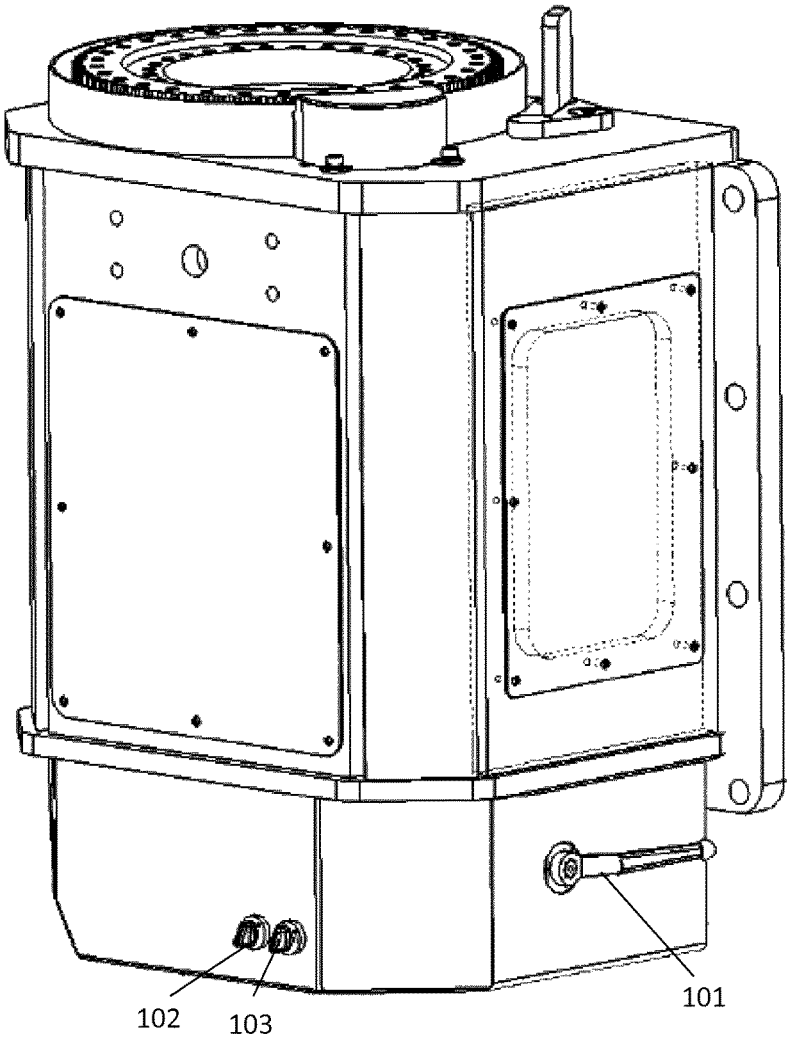
FIG. 26 is a perspective view of the upright column.

Referring to drawings and now to FIG. 26, the power supply of the boom system 1 has an arrangement 101 for isolating the length adjustable upright column actuator 4 and the mechanical lock actuator 92 from the tool head actuator 59, the dipper arm actuator 58 and the boom arm actuator 57. The isolating arrangement 101 of the boom system 1 has a manual diverter valve 101. The manual diverter valve 101 protrudes from the base 60. The power supply of the boom system 1 has a switch arrangement 102, 103 for operating the length adjustable upright column actuator 4 and the mechanical lock actuator 92. In use the diverter valve 101 is operated to divert hydraulic fluid into a CETOP valve. One of the switches 102 is pressed to activate a solenoid on the CETOP valve to send hydraulic fluid to the upright column actuator 4 to release the weight of the locking pin 88. The second switch 103 is switched to activate the solenoid on the CETOP valve to send hydraulic fluid to the actuator 92 for the mechanical lock 81 to release the locking pin 88 from the internal upright column 85. The switch 102 is pressed again until the inner column begins to lower and then an operator releases switch 103. In order to raise the upright column, switch 102 is pressed to send hydraulic fluid to upright column actuator 4. The locking pin 88 engages automatically with alignment of the apertures 86, 87 giving a failsafe mechanical lock.

The base 60 has a box shaped housing with a floor and an open top wall with one wall be mounted against a wall of the crusher. The housing having removable guards for providing access to all hydraulic and electrical connections, the guards being attached to the housing via fasteners which are accessible to tools for removing and attaching the fasteners when the housing is mounted on the crusher.

In the preceding discussion of the invention, unless stated to the contrary, the disclosure of alternative values for the upper or lower limit of the permitted range of a parameter, coupled with an indication that one of the said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The features disclosed in the foregoing description or the following drawings, expressed in their specific forms or in terms of a means for performing a disclosed function, or a method or a process of attaining the disclosed result, as appropriate, may separately, or in any combination of such features be utilised for realising the invention in diverse forms thereof as defined in the appended claims.

The invention claimed is:

1. A rock breaker boom system for breaking oversize material and clearing or preventing blockages in a crusher, the rock breaker boom system being adapted to be mounted on or attached to a crusher, the rock breaker boom system comprising:

a base;

an upright column protruding upwardly from the base;

a boom arm moveably connected to the upright column;

a dipper arm connectable to the boom arm;

a tool head connectable to the dipper arm, the tool head being adaptable for breaking oversized material;

an arrangement for rotating the upright column, the arrangement for rotating the upright column being operably coupled between the base and the upright column; and means for moving all or part of the upright column towards and away from the base so that a connection between the boom arm and the upright column is moveable towards and away from the base.

2. The rock breaker boom system as claimed in claim 1, wherein the rock breaker boom system is mountable on a crusher with a hopper, the rock breaker boom system being mountable at a position enabling the rock breaker boom system to engage with material within the hopper of the crusher, wherein the means for moving all or part of the upright column is adaptable to move the connection between the boom arm and the upright column such that the boom arm substantially or completely extends into a space above the hopper.

3. The rock breaker boom system as claimed in claim 2, wherein the rock breaker boom system is mountable so as to be proximal to an upright wall of the hopper of the crusher wherein the means for moving all or part of the upright column is adaptable to move the connection between the boom arm and the upright column towards and away from a top of the upright wall of the hopper.

4. The rock breaker boom system as claimed in claim 3, wherein the means for moving all or part of the upright column is adaptable to move the connection between the boom arm and the upright column to be proximal to, level with, or above the top of the upright wall of the hopper.

5. The rock breaker boom system as claimed in claim 1, further comprising one or more actuators located on an outer side of the boom system.

6. The rock breaker boom system as claimed in claim 1, further comprising a boom arm actuator for actuating the boom arm relative to the upright column wherein the boom arm actuator is locatable on an outer side of the rock breaker boom system.

7. The rock breaker boom system as claimed in claim 1, wherein the arrangement for rotating the upright column comprises a slewing system or at least one telescopic actuator adaptable to rotate the upright column.

8. A crusher comprising a rock breaker boom system for breaking oversize material and clearing or preventing blockages in the crusher, the rock breaker boom system, comprising:

a base;

an upright column protruding upwardly from the base;

a boom arm moveably connected to the upright column;

a dipper arm connectable to the boom arm;

a tool head connectable to the dipper arm, the tool head being adaptable for breaking oversized material;

an arrangement for rotating the upright column, the arrangement for rotating the upright column being operably coupled between the base and the upright column; and means for moving all or part of the upright column towards and away from the base so that a connection between the boom arm and the upright column is moveable towards and away from the base.

* * * * *